US010079125B2

(12) United States Patent
Izawa et al.

(10) Patent No.: US 10,079,125 B2
(45) Date of Patent: Sep. 18, 2018

(54) ILLUMINATED PUSH-BUTTON SWITCH HAVING FIXED MEMBER AND KEYBOARD INCLUDING SAME

(71) Applicant: OMRON Corporation, Kyoto-shi, Kyoto (JP)

(72) Inventors: Kazuhira Izawa, Okayama (JP); Mamiko Naka, Okayama (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/113,225

(22) PCT Filed: Jul. 31, 2014

(86) PCT No.: PCT/JP2014/070234
§ 371 (c)(1),
(2) Date: Jul. 21, 2016

(87) PCT Pub. No.: WO2015/118706
PCT Pub. Date: Aug. 13, 2015

(65) Prior Publication Data

US 2017/0011871 A1 Jan. 12, 2017

(30) Foreign Application Priority Data

Feb. 7, 2014 (JP) ..... 2014-022833

(51) Int. Cl.
*H01H 13/02* (2006.01)
*H01H 13/83* (2006.01)
(Continued)

(52) U.S. Cl.
CPC ..... *H01H 13/83* (2013.01); *H01H 1/5805* (2013.01); *H01H 13/023* (2013.01);
(Continued)

(58) Field of Classification Search
CPC ..... H01H 13/023; H01H 13/83; H01H 2219/036; H01H 2219/062
(Continued)

(56) References Cited

U.S. PATENT DOCUMENTS 6,743,993 B1 * 6/2004 Clark ..... H01H 13/702 200/314
6,969,815 B1 11/2005 Lu
(Continued)

FOREIGN PATENT DOCUMENTS

CN 203339029 U 12/2013
JP H07-1544 U 1/1995
(Continued)

OTHER PUBLICATIONS

European search opinion dated Aug. 28, 2017 in a counterpart European patent application.
(Continued)

*Primary Examiner* — Vanessa Girardi
(74) *Attorney, Agent, or Firm* — Metrolexis Law Group PLLC

(57) ABSTRACT

An illuminated push-button switch according to the present invention includes a key top, a plunger, and a supporting fix member that forms a space between the key top and the plunger, and supports and fixes together the key top and the plunger. A plurality of the supporting fix members are provided, separated from each other, in a plane perpendicular to an optical axis. With this configuration, the illuminated push-button switch having a wide illuminated region secured on a touch surface, and a keyboard can be provided.

9 Claims, 19 Drawing Sheets

(51) Int. Cl.

| | |
|---|---|
| ***H01H 1/58*** | (2006.01) |
| ***H01H 13/807*** | (2006.01) |
| *H01H 9/18* | (2006.01) |
| *H01H 13/52* | (2006.01) |

(52) U.S. Cl.
CPC ..... *H01H 13/807* (2013.01); *H01H 9/18* (2013.01); *H01H 13/52* (2013.01); *H01H 2219/062* (2013.01); *H01H 2221/044* (2013.01); *H01H 2229/042* (2013.01); *H01H 2233/072* (2013.01)

(58) Field of Classification Search
USPC ..... 200/314, 520, 310, 313
See application file for complete search history.

(56) References Cited

U.S. PATENT DOCUMENTS

| | | | | |
|---|---|---|---|---|
| 7,122,756 | B2 * | 10/2006 | Sasaki | H01H 13/28 200/16 C |
| 7,554,047 | B2 * | 6/2009 | Verdu | H01H 13/023 200/314 |
| 2006/0000699 | A1 | 1/2006 | Sasaki et al. | |

FOREIGN PATENT DOCUMENTS

| | | | |
|---|---|---|---|
| JP | 2006-019131 | A | 1/2006 |
| JP | 2006-302555 | A | 11/2006 |

OTHER PUBLICATIONS

Supplementary European search report dated Aug. 28, 2017 in a counterpart European patent application.

* cited by examiner (a) FIG. 1
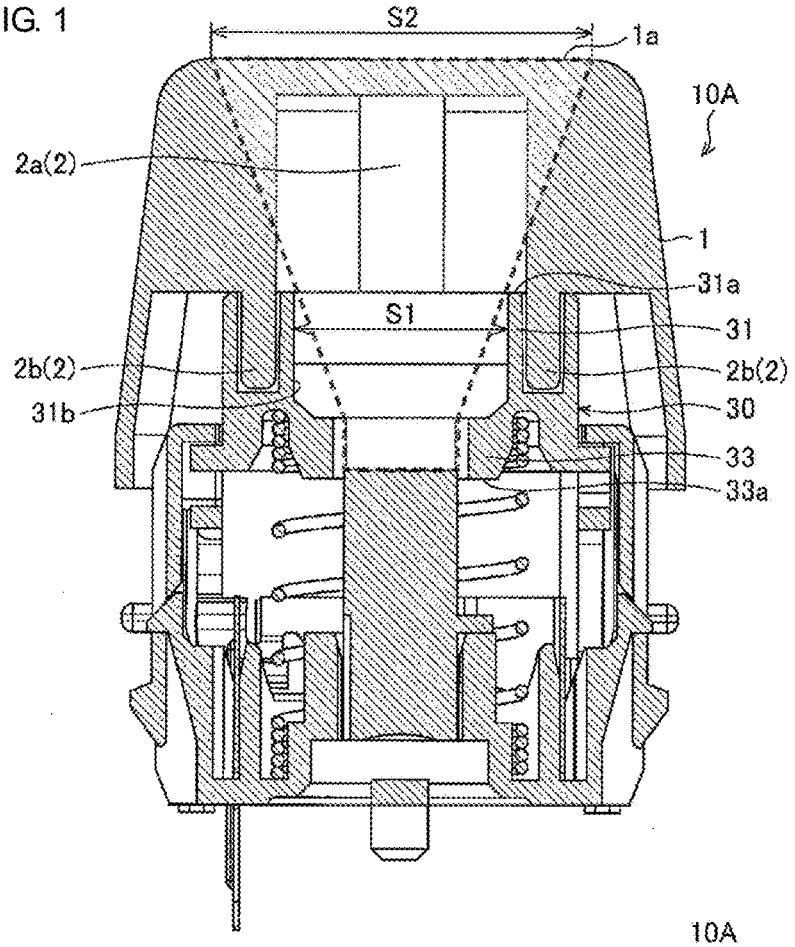
(b)
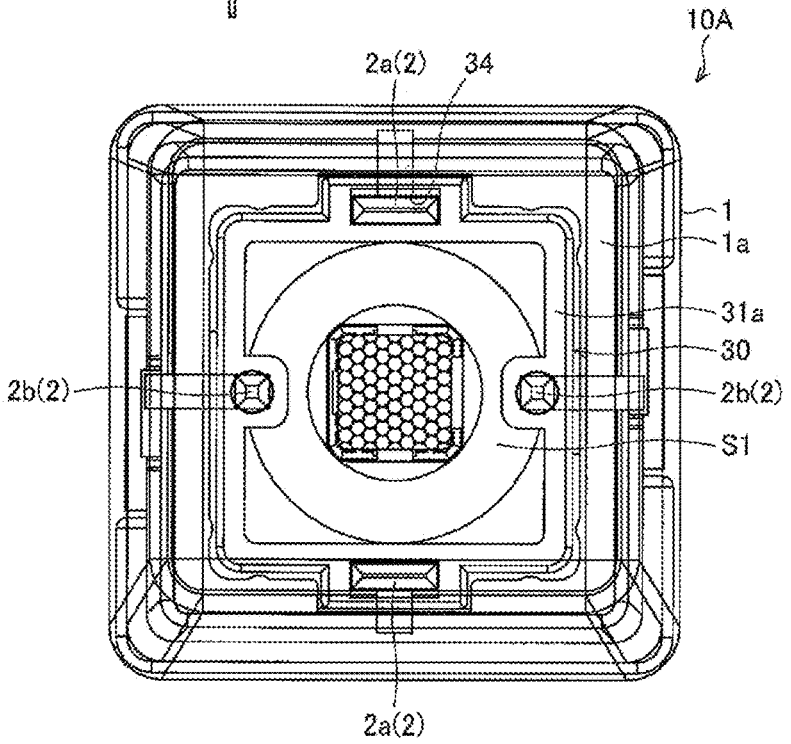

FIG. 4
(a)
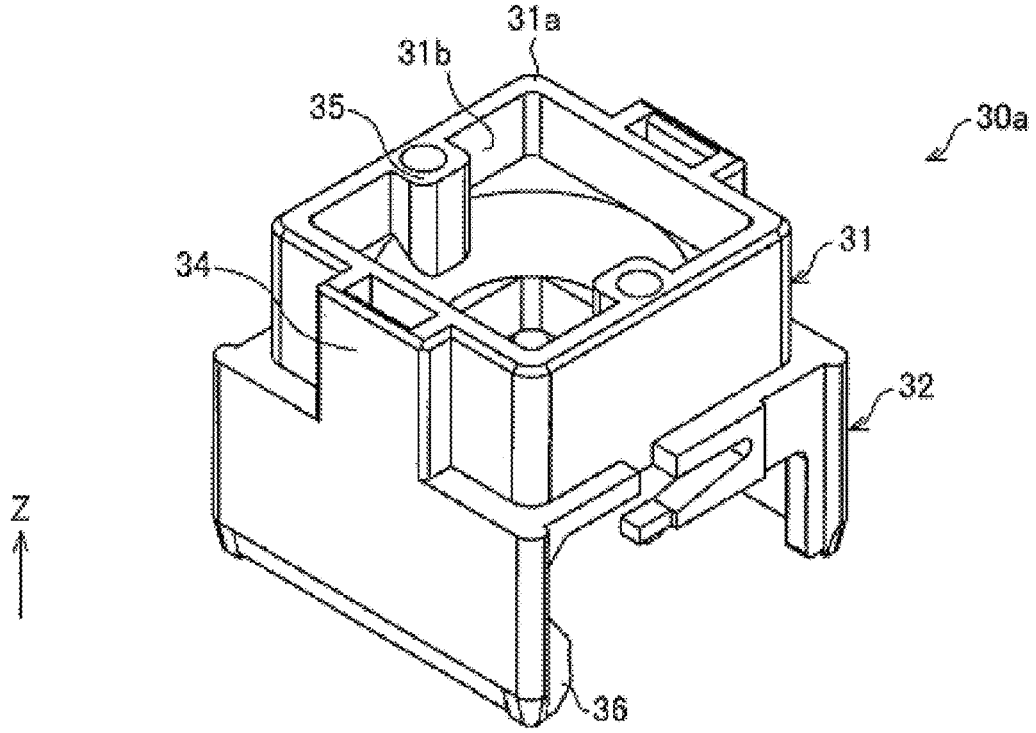
(b)
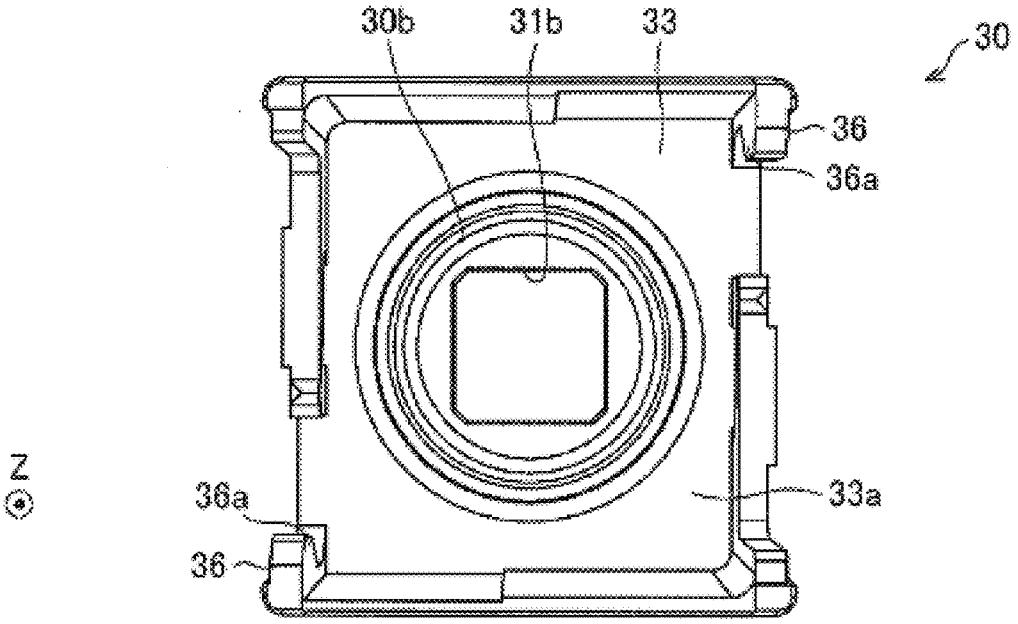

FIG. 7
(a)
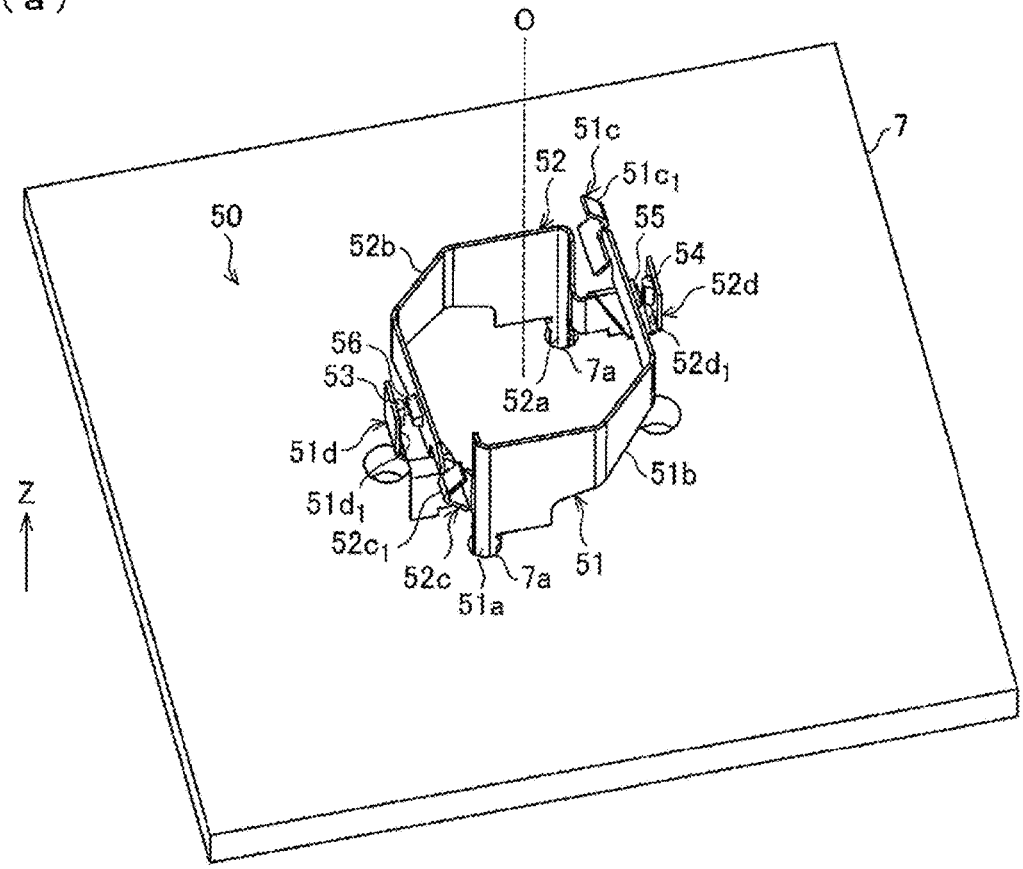
(b)
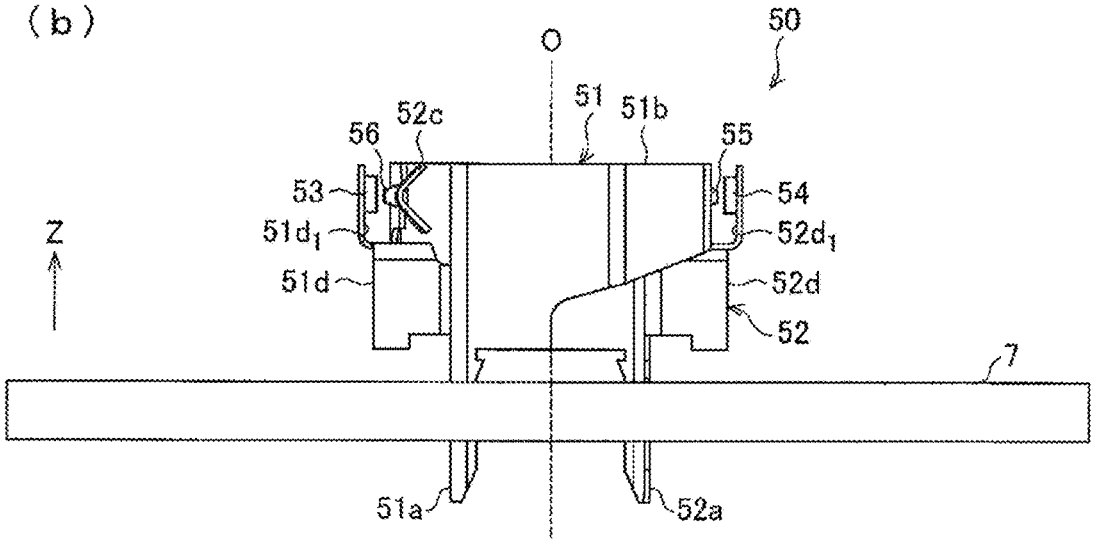

FIG. 13
(a)
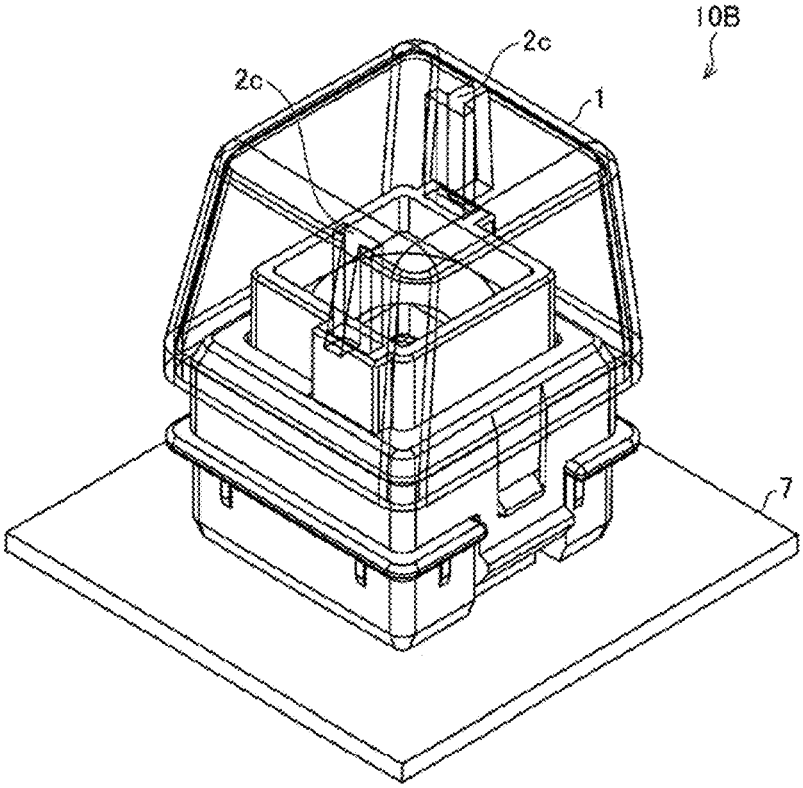
(b)
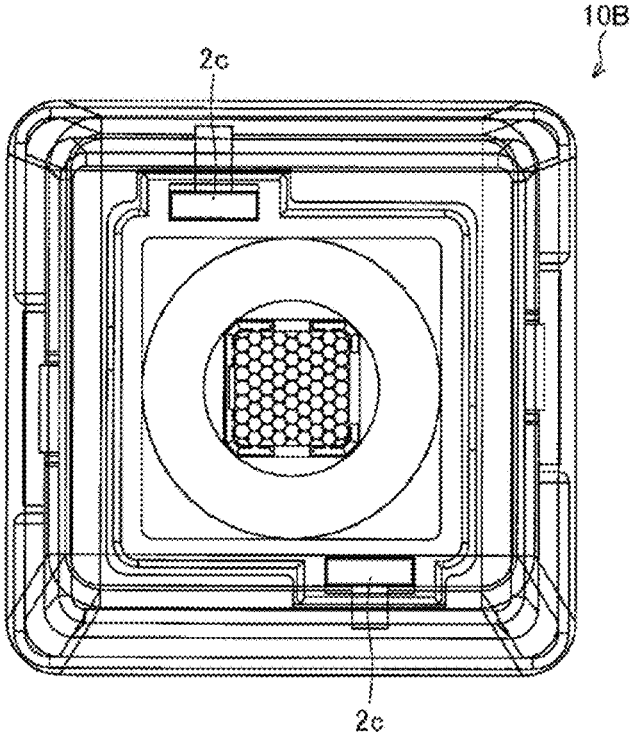

FIG. 14
(a)
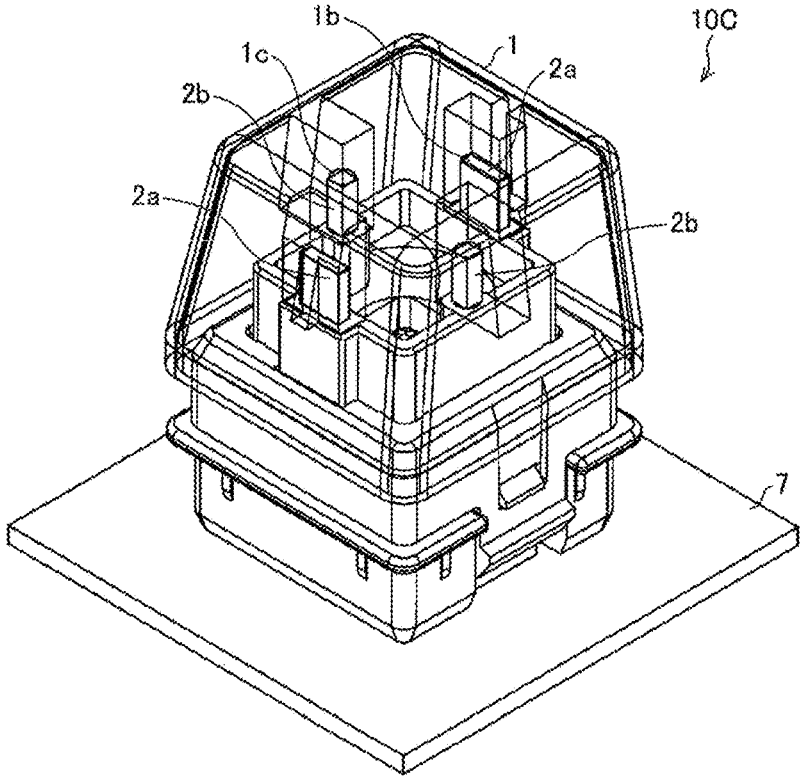
(b)
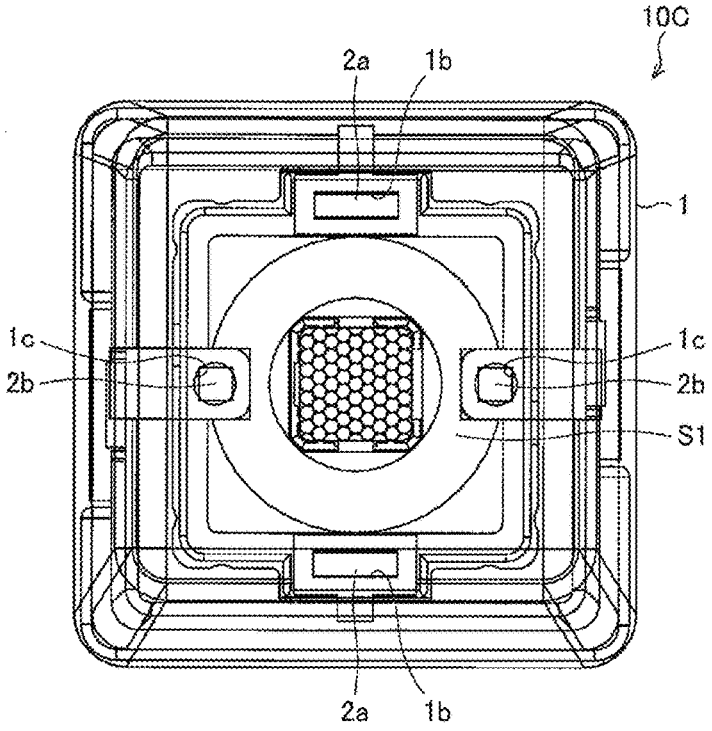

FIG. 15
(a)
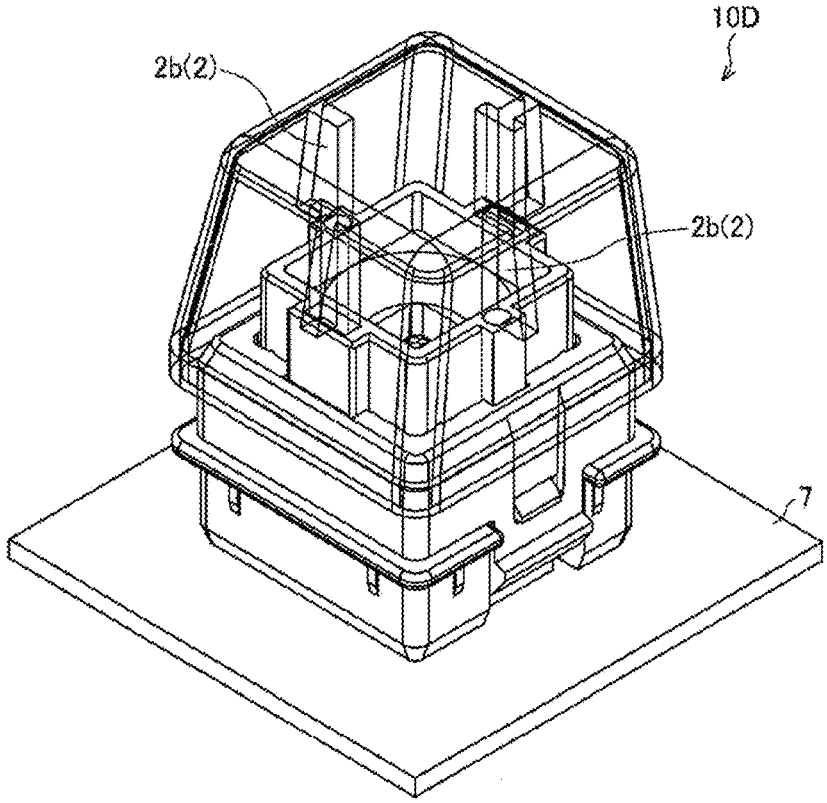
(b)
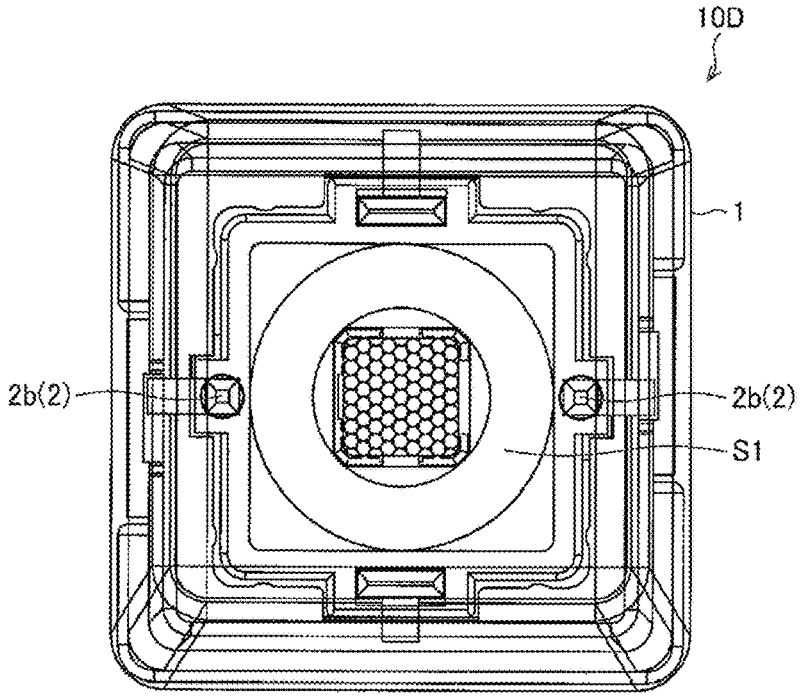

FIG. 16
(a)
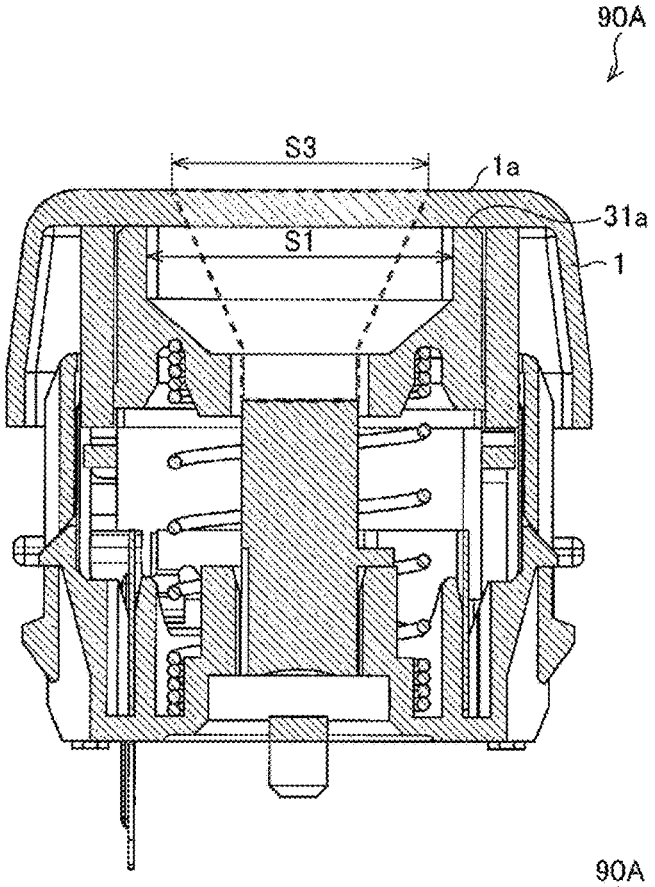
(b)
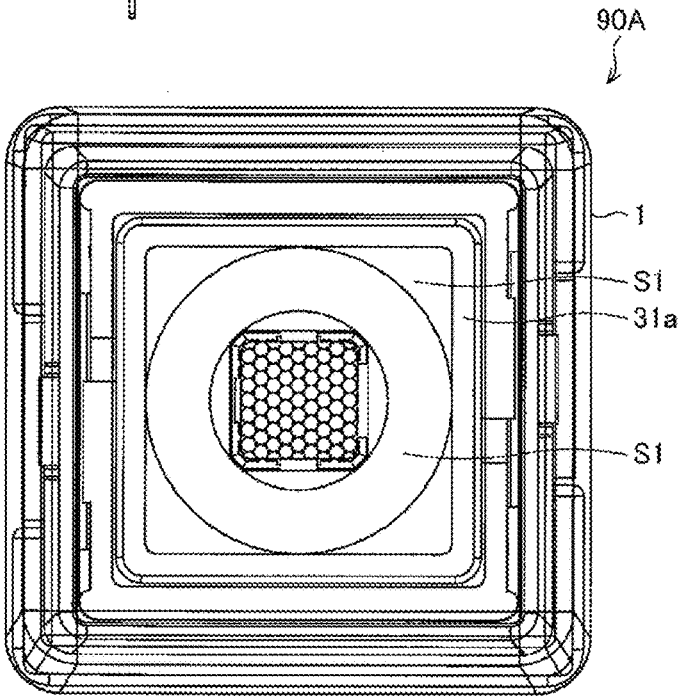

FIG. 17
(a)
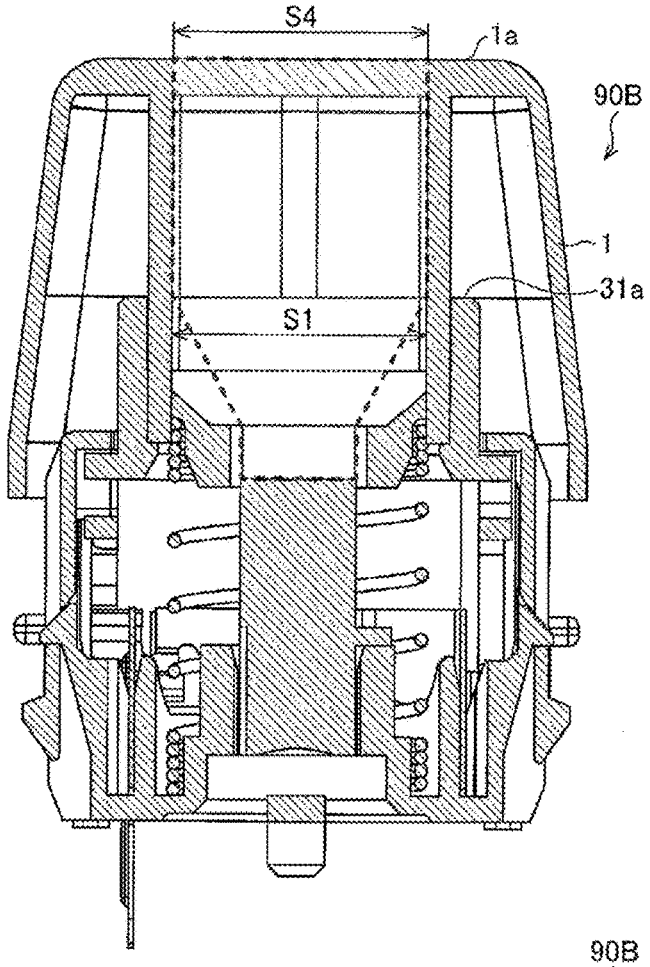
(b)
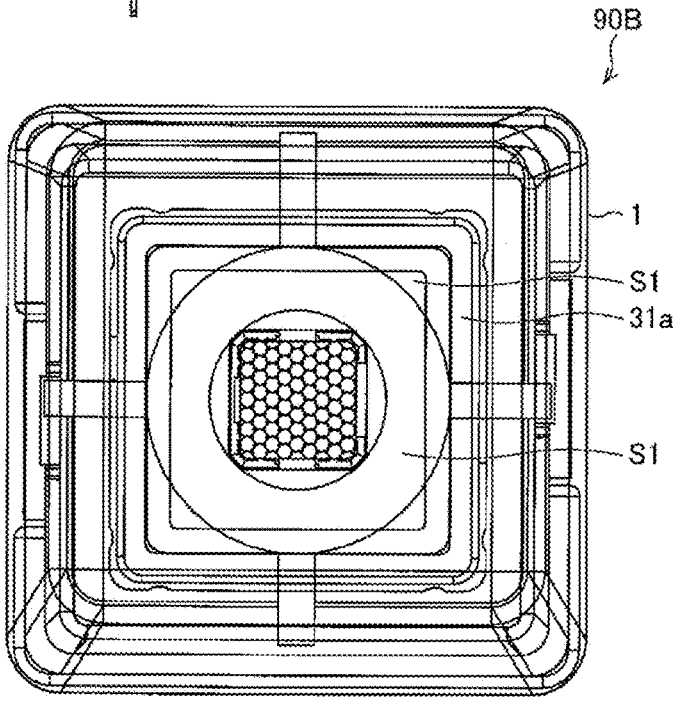

ILLUMINATED PUSH-BUTTON SWITCH HAVING FIXED MEMBER AND KEYBOARD INCLUDING SAME

TECHNICAL FIELD

The present invention relates to an illuminated push-button switch in which a contact unit is set on or off via a push-button by pressing a covering member upper-surface, and to a keyboard. More specifically, the present invention relates to an illuminated push-button switch in which approximately the whole area of a covering member upper-surface is illuminated, and to a keyboard.

BACKGROUND ART

It is conventionally known that an illuminated push-button switch of which a surface or a key top is illuminated is used for a key of a push phone device and a keyboard.

As illustrated in FIG. 18, for example, an illuminated push-button switch 100 provided in a phone device disclosed in Patent Document 1 includes a key-pad member 110 having a light guiding part 111 that allows the light emitted from an LED 101 to pass therethrough, and a push-button member 120 that covers from a light exit surface 111*a* of the light guiding part 111 formed in the center of the key-pad member 110 to a portion of an outer wall surface 112 of the key-pad member 110.

In the illuminated push-button switch 100, the light emitted from the LED 101 is guided through the light guiding part 111 to a touch surface 121 of the push-button member 120. Thus, the emitted light concentrates at a portion of the touch surface 121 of the push-button member 120, and the luminescence at this portion increases. As a result, the visibility of the touch surface 121 improves.

In another configuration, as illustrated in FIGS. 19(*a*) and 19(*b*), for example, a keyboard switch 200 disclosed in Patent Document 2 includes a key-cap 210, a casing 201, a push-button member 220 slidable to the lower side and including a cylindrical member 221 that protrudes from an opening 201*a* of the casing 201, and an LED 202 provided in the center of the push-button member 220. As illustrated in FIG. 19(*c*), a cylindrical part 211 formed on the back side of the key-cap 210 fits onto the cylindrical member 221 of the push-button member 220.

The illuminated push-button switch 100 disclosed in Patent Document 1 and the keyboard switch 200 disclosed in Patent Document 2 each have an upper-surface area of the push-button member 120 or the key-cap 210, which is the key top, larger than the area of the button, which is the key-pad member 110 or the push-button member 220.

PRIOR ART DOCUMENTS

Patent Documents

Patent Document 1: JP 2006-302555 A (Publication Date: May 4, 2006)

Patent Document 2: CN 203339029 Y (Registration Date: Dec. 11, 2013)

SUMMARY OF THE INVENTION

Problems to be Solved by the Invention

For an illuminated push-button switch that has a larger key top upper-surface area than a button upper-surface area, it is preferable to illuminate the whole key top upper-surface. The space occupied by a contact mechanism however limits the cross sectional area of a light source disposed in the center of the switch. Accordingly, the region irradiated with the emitted light from the light source should be enlarged before reaching the key top upper-surface with as minimal objects that block the emitted light as possible.

The conventional illuminated push-button switches as disclosed in Patent Documents 1 and 2 however have disadvantages as described below.

In the illuminated push-button switch 100 disclosed in Patent Document 1, the light exit surface 111*a* of the light guiding part 111 is in contact with the push-button member 120. Accordingly, the area on the touch surface 121, which is the upper-surface of the push-button member 120, irradiated with the light passed through the light guiding part 111 is not enlarged. The irradiated area on the touch surface 121, which is the upper-surface of the push-button member 120, is therefore smaller than the area of the upper-surface of the key-pad member 110.

In the keyboard switch 200 disclosed in Patent Document 2, the cylindrical member 221 is provided on the upper side of the push-button member 220, and the cylindrical part 211 formed on the back side of the key-cap 210 fits onto the cylindrical member 221. This structure secures the strength to couple together the push-button member 220 and the key-cap 210.

The cylindrical member 221 and the cylindrical part 211 however block the light emitted from an LED 202, and the irradiated area on the upper-surface of the key-cap 210 is as large as the area of the light emission port of the push-button member 220.

As a result, in the techniques disclosed in Patent Documents 1 and 2, disadvantageously approximately the entire region of the key top upper-surface cannot be irradiated with light.

The present invention has been made in view of the aforementioned conventional problems. An object of the present invention is to provide an illuminated push-button switch that has a wide illuminated region secured on a touch surface and to provide a keyboard.

Means for Solving the Problems

To solve the aforementioned problems, an illuminated push-button switch according to one embodiment of the present invention includes a push-button, a covering member configured to cover at least a push-button upper-surface of the push-button and having a covering member upper-surface receiving light entering from below the push-button through the push-button, and a contact unit configured to be set on or off via the push-button by pushing the covering member upper-surface serving as a touch surface. A supporting fix member forms a space between the covering member and the push-button, and supports and fixes together the covering member and the push-button. A plurality of the supporting fix members are provided, separated from each other, in a plane perpendicular to an optical axis.

To solve the aforementioned problems, a keyboard according to one embodiment of the present invention includes the illuminated push-button switch.

Effects of the Invention

The present invention provides an illuminated push-button switch that has a wide illuminated region secured on the touch surface, and a keyboard.

BRIEF DESCRIPTION OF THE DRAWINGS

FIG. 1(*a*) is a longitudinal sectional view illustrating a configuration of an illuminated push-button switch according to a first embodiment of the present invention. FIG. 1(*b*) is a transverse sectional view of the configuration of the illuminated push-button switch.

FIG. 4(*a*) is a perspective view illustrating a configuration of a plunger body of the illuminated push-button switch. FIG. 4(*b*) is a bottom view illustrating a configuration of a plunger of the illuminated push-button switch.

FIG. 7(*a*) is a perspective view illustrating a configuration of the contact mechanism provided on a base plate of the illuminated push-button switch. FIG. 7(*b*) is a side view of the same.

FIGS. 9*c* and 9(*d*) are partially enlarged views each illustrating a motion of a contact portion of a movable plate and a cam of the plunger body of the illuminated push-button switch.

FIG. 13(*a*) is a perspective view illustrating a configuration of an exemplary modification of the illuminated push-button switch according to the first embodiment of the present invention. FIG. 13(*b*) is a transverse sectional view of the configuration of the exemplary modification of the illuminated push-button switch.

FIG. 14(*a*) is a perspective view illustrating a configuration of another exemplary modification of the illuminated push-button switch according to the first embodiment of the present invention. FIG. 14(*b*) is a transverse sectional view of the configuration of the exemplary modification of the illuminated push-button switch.

FIG. 15(*a*) is a perspective view illustrating a configuration of still another exemplary modification of the illuminated push-button switch according to the first embodiment of the present invention. FIG. 15(*b*) is a transverse sectional view of the configuration of the exemplary modification of the illuminated push-button switch.

FIG. 16(*a*) is a longitudinal sectional view illustrating a configuration of a comparative example of the illuminated push-button switch according to the first embodiment of the present invention. FIG. 16(*b*) is a transverse sectional view of the configuration of the comparative example of the illuminated push-button switch.

FIG. 17(*a*) is a longitudinal sectional view illustrating a configuration of another comparative example of the illuminated push-button switch according to the first embodiment of the present invention. FIG. 17(*b*) is a transverse sectional view of the configuration of the comparative example of the illuminated push-button switch.

FIG. 19(*b*) is a perspective view illustrating the configuration of the conventional illuminated push-button switch without a key-cap. FIG. 19(*c*) is a perspective view illustrating a configuration of the back side of the key-cap.

MODE FOR CARRYING OUT THE INVENTION

An embodiment of the present invention will now be described with reference to FIGS. 1 to 17(*b*).

An illuminated push-button switch according to the embodiment is a contact-type switch suitable to be used, in particular, as an illuminated switch assembled in a keyboard. The present invention is not only applicable to an illuminated push-button switch assembled in a keyboard but also to an illuminated push-button switch assembled in, for example, an industrial operation panel, an imaging device control panel for professional use, or a commercial device.

(Configuration of Illuminated Push-Button Switch)

Figure 2:
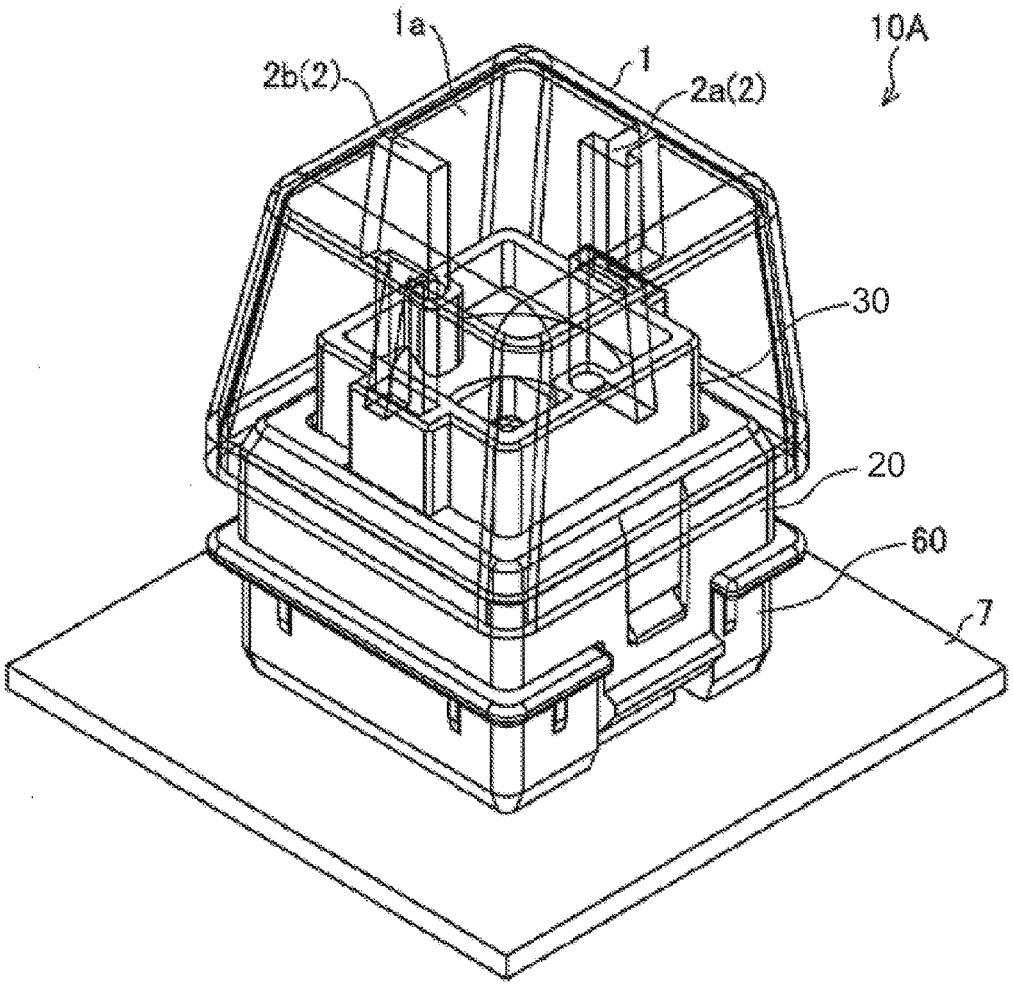
FIG. 2 is a perspective view illustrating an overall configuration of the illuminated push-button switch.
Figure 3:
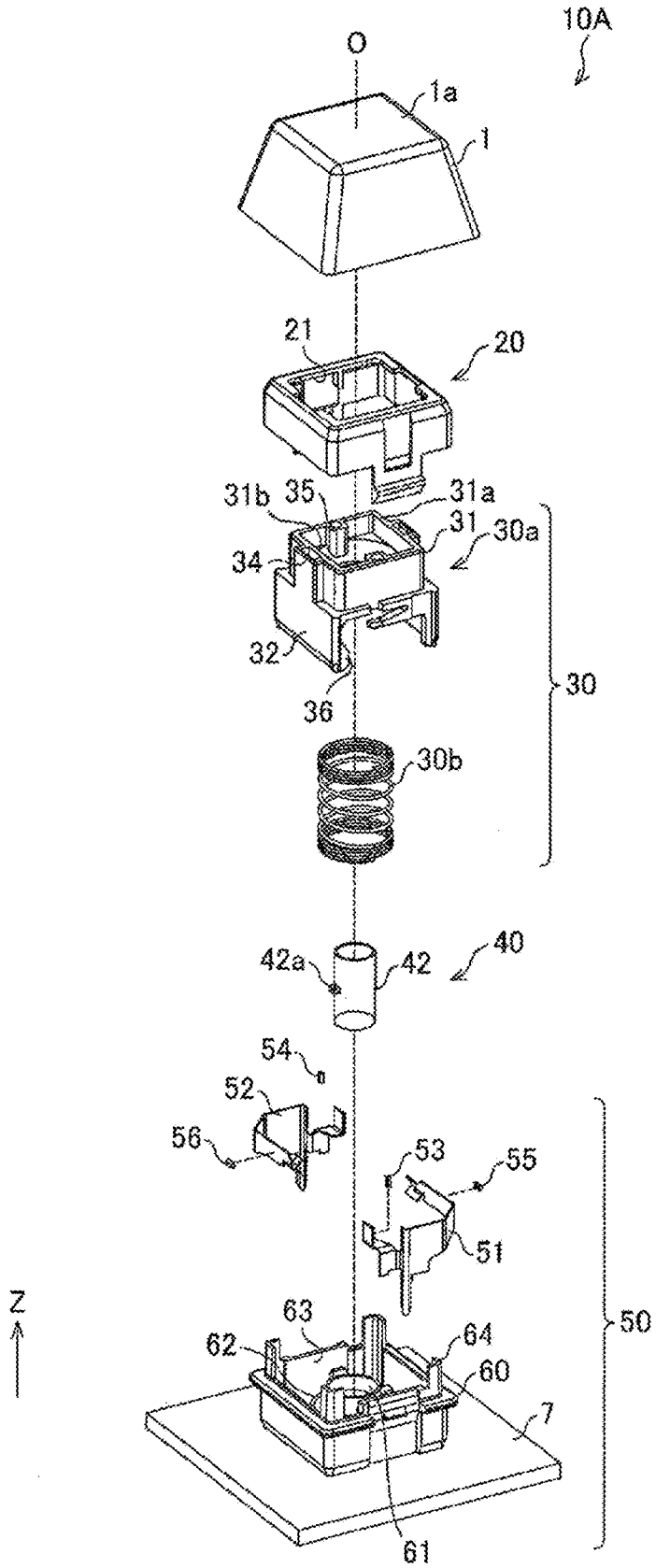
FIG. 3 is an exploded perspective view illustrating the overall configuration of the illuminated push-button switch.
Figure 5:
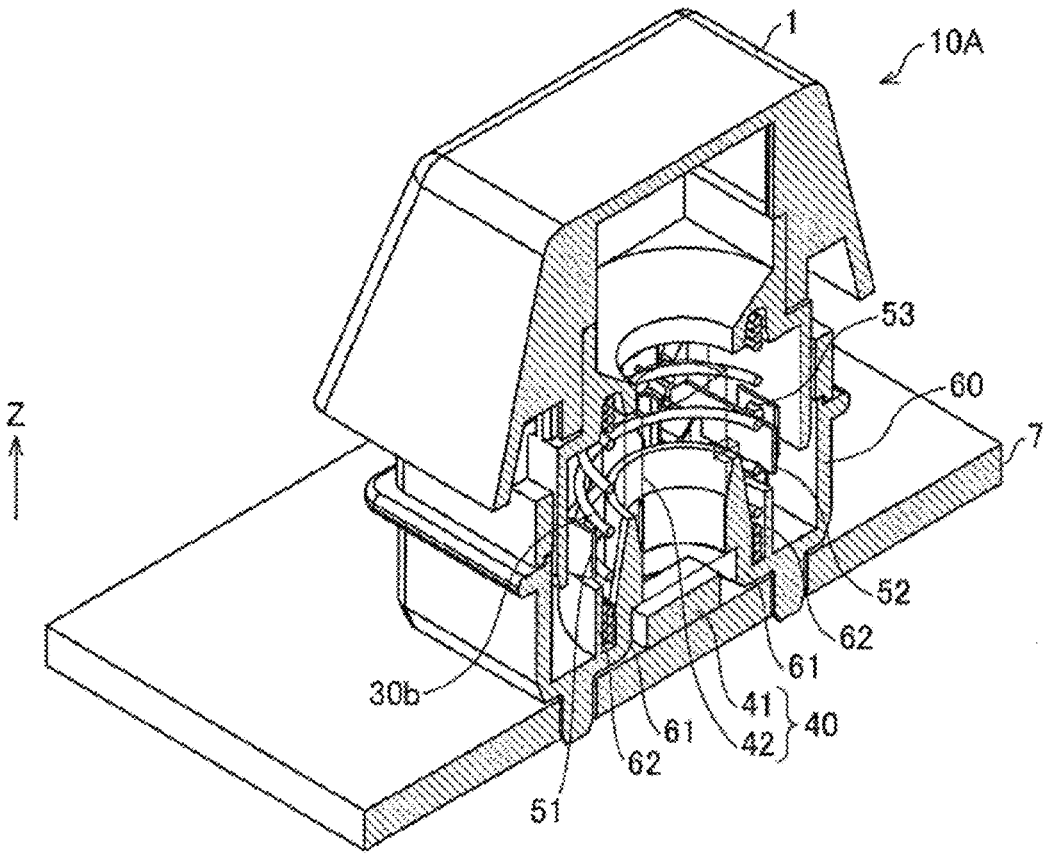
FIG. 5 is a cutaway perspective view illustrating the overall configuration of the illuminated push-button switch with a portion being cut away.

A configuration of an illuminated push-button switch 10A according to the embodiment will now be described with reference to FIG. 2 to FIG. 5. FIG. 2 is a perspective view illustrating an overall configuration of the illuminated push-button switch. FIG. 3 is an exploded perspective view illustrating the overall configuration of the illuminated push-button switch. FIG. 4(*a*) is a perspective view illustrating a configuration of a plunger body of the illuminated push-button switch. FIG. 4(*b*) is a bottom view illustrating a configuration of a plunger of the illuminated push-button switch. FIG. 5 is a cutaway sectional view illustrating the overall configuration of the illuminated push-button switch with a portion being cut away.

As illustrated in FIGS. 2 and 3, an illuminated push-button switch 10A according to the embodiment includes a key top 1 as a covering member, an upper case 20, a plunger 30 as a push-button, a light source 40, a contact mechanism 50 as a contact unit, a lower case 60, and a base plate 7.

The components will be described below in order. The key top 1 and the plunger 30 will be described later in detail.

The key top 1 has a shape of a near-square box covering the whole plunger 30. The shape of the near-square-box-shaped key top 1 is not necessarily a truncated square pyramid but may be a truncated rectangular pyramid. The shape of the key top 1 is not necessarily a near-square box but may be a circular or elliptic sleeve.

Figure 20:
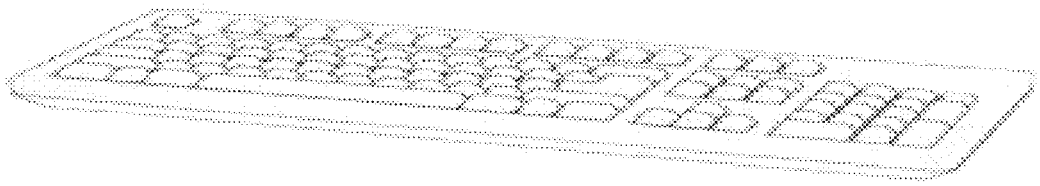
FIG. 20 is a view illustrating an example of a keyboard in which a push-button switch is included.

The key top upper-surface 1*a* of the key top 1 is a touch surface for operating a key of a keyboard, that is, pushed by a finger. An example of a suitable keyboard is illustrated in FIG. 20.

Examples of a material of the key top 1 may include a molding resin material, such as poly butylene terephthalate (PBT) resin, poly carbonate (PC) resin, acrylonitrile butadiene styrene copolymer (ABS) resin, or a light transmissive material, such as poly carbonate (PC) resin or acrylic resin.

The upper case 20 fits on the lower case 60 to cover the contact mechanism 50 and to support the plunger 30 in a manner movable in the vertical direction. The upper case 20 is formed in a square-shaped frame with an inner space 21 in which a plunger upper-wall 31 of a plunger body 30*a*, which will be described later, can be inserted.

The plunger 30 includes the plunger body 30*a* and a coil spring 30*b*. The direction in which the illuminated push-button switch 10A is pushed is determined as Z direction. Regarding the Z direction, the key top 1 is on the upper side, and the base plate 7 is on the lower side.

The plunger body 30*a* includes the plunger upper-wall 31 formed in a square-shaped frame and a plunger lower-wall 32. A plunger floor 33 is provided between the plunger upper-wall 31 and the plunger lower-wall 32.

Press-fit holes 34 and 34 and press-fit holes 35 and 35 that engage with supporting fix members 2, which will be described later, provided on the back side of the key top 1 are formed in the plunger upper-wall 31 of the plunger body 30*a*. Thus, the plunger upper-wall 31 of the plunger body 30*a* is inserted through the inner space 21 of the upper case 20 to engage with the key top 1.

A plunger through hole 31*b* in which a light guiding bar 42 serving as a light guiding member, which will be described later, can be inserted is provided in the central portion of the plunger floor 33. The plunger through hole 31*b* has, for example, a square cross section. The shape of the cross section of the plunger through hole 31*b* is not limited to a square.

A cam 36 that engages with the contact mechanism 50 is provided on the plunger lower-wall 32 of the plunger body 30*a*. As illustrated in FIG. 4(*b*), the cam 36 has a protrusion-and-recess surface 36*a* that protrudes and is recessed in a transverse direction perpendicular to the Z direction.

The coil spring 30*b* is disposed on, making contact with, the back side of the plunger floor 33. The coil spring 30*b* is contained in the lower case 60 in a manner that, when the plunger body 30*a* is pushed downward by pushing the key top 1, the coil spring 30*b* produces an elastic force acting against the pushing force.

As illustrated in FIGS. 3 and 5, the LED 41 and the light guiding bar 42 serving as the light guiding member constitute the light source 40. The LED 41 is embedded in the base plate 7.

As illustrated in FIGS. 3 and 5, the lower case 60 has a form of a squared pillar box and is attached to the base plate 7. When viewed from above, a cylindrical insertion tube 61 which is inserted in the base plate 7 is provided approximately in the center of the lower case 60. The light source 40 is contained in the cylindrical insertion tube 61. Specifically, the LED 41 embedded in the base plate 7 is disposed directly-under the cylindrical insertion tube 61. The light guiding bar 42 is inserted in the cylindrical insertion tube 61. A light guiding bar side-surface 42*a* engages with the cylindrical insertion tube 61 to support and fix the light guiding bar 42 at a predetermined position. The light emitted from the LED 41 is coupled to the light guiding bar 42 and guided through the light guiding bar 42 to exit to the upper side.

An insertion tube 62 is provided in the lower case 60 to surround the cylindrical insertion tube 61. The insertion tube 62 does not extend beyond the bottom-surface of the lower case 60, and is not inserted in the base plate 7. The coil spring 30*b* in the plunger 30 is contained in the space between the outer wall of the cylindrical insertion tube 61 and the inner-surface of the insertion tube 62. That is, the cylindrical insertion tube 61 and the insertion tube 62 demarcate a middle space in the lower case 60. The contact mechanism 50 is contained in the space surrounded by the outer wall of the insertion tube 62 and the lower case wall 63 of the lower case 60.

When viewed from above, four corner projections 64 each projecting upward, keeping an angled shape, are provided on each corner of the squared shape of the lower case wall 63. The four corner projections 64 engage with the shape formed in the lower portion of the plunger body 30*a* of the plunger 30 to support the plunger body 30*a*. The corner projections 64 function as the guide for guiding downward the plunger body 30*a* when the illuminated push-button switch 10A is pushed.

Figure 6:
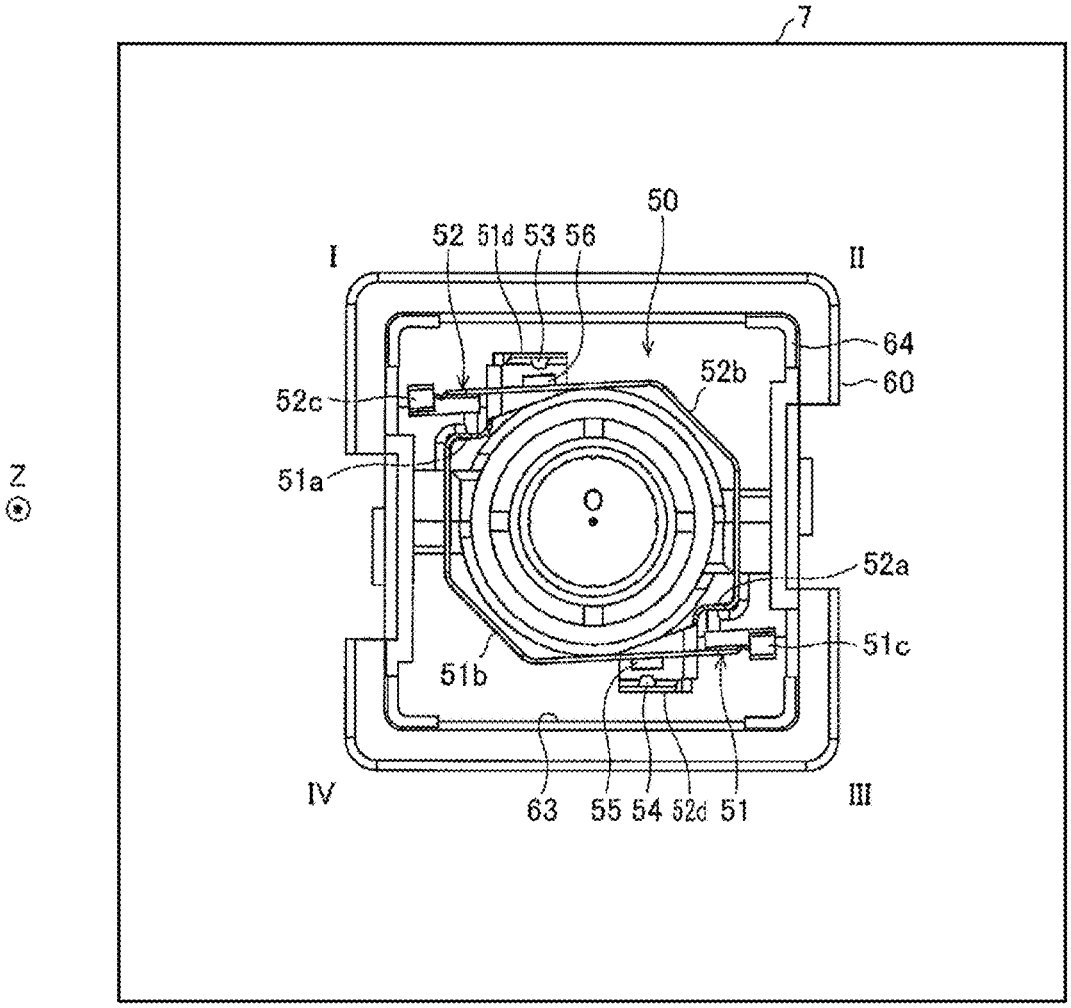
FIG. 6 is a plan view illustrating a configuration of a contact mechanism contained in a lower case of the illuminated push-button switch.

The configuration of the contact mechanism 50 will now be described with reference to FIGS. 6, 7(*a*), and 7(*b*). FIG. 6 is a plan view illustrating the configuration of the contact mechanism contained in the lower case of the illuminated push-button switch. FIG. 7(*a*) is a perspective view illustrating the configuration of the contact mechanism provided on the base plate of the illuminated push-button switch. FIG. 7(*b*) is a side view of the same.

As illustrated in FIGS. 6, 7(*a*), and 7(*b*), the contact mechanism 50 includes two movable plates 51 and 52, fixed contacts 53 and 54, and movable contacts 55 and 56. The movable plate 51 is provided with a fixed contact 53 and a movable contact 55. The movable plate 52 is provided with a fixed contact 54 and a movable contact 56.

The movable plates 51 and 52 are formed of a conductive material. As illustrated in FIGS. 7(*a*) and 7(*b*), the movable plates 51 and 52 include projecting terminals 51*a* and 52*a* each penetrating a through hole 7*a* provided in the base plate 7 to be connected to the external. The movable plates 51 and 52 are supported by the projecting terminals 51*a* and 52*a* on the base plate 7.

The movable plates 51 and 52 include sliding portions 51*b* and 52*b* each having a near-L-shape, when viewed from above, continuing from the projecting terminals 51*a* and 52*a*. Contact portions 51*c* and 52*c* that make contact with the cams 36 of the plunger body 30*a* are provided on ends opposite to the projecting terminals 51*a* and 52*a* of the sliding portions 51*b* and 52*b*. The contact portions 51*c* and 52*c* each has a V-shape projecting toward the outer side. In the illuminated push-button switch 10A, projecting tips 51*c*1 and 52*c*1 of the V-shaped contact portions 51*c* and 52*c* are making contact with the protrusion-and-recess surfaces 36*a* of the cams 36. While the projecting tips 51*c*1 and 52*c*1 of the contact portions 51*c* and 52*c* are in contact with the protrusion-and-recess surfaces 36*a*, the sliding portions 51*b* and 52*b* produce outward urging forces in directions perpendicular to the Z direction. That is, while the switch is being pushed, the sliding portions 51*b* and 52*b* function as plate springs that elastically deform in a direction perpendicular to the Z direction with the projecting terminals 51*a* and 52*a* working as fulcrums and the contact portions 51*c* and 52*c* as the point of efforts.

As described above, the bent sliding portions 51*b* and 52*b* are disposed in an outer circumferential space between the insertion tube 62 and the lower case wall 63. The bent portion of each of the sliding portions 51*b* and 52*b* is not necessarily formed by tightly bending a plate as illustrated in FIGS. 6 and 7(*a*) but may be formed by, for example, curving a plate.

The movable plates 51 and 52 are provided with fixed supports 51*d* and 52*d* in portions other than where the sliding portions 51*b* and 52*b* and the projecting terminals 51*a* and 52*a* are provided. Unlike the sliding portions 51*b* and 52*b*, the fixed supports 51*d* and 52*d* do not deform by pushing the switch. The fixed supports 51*d* and 52*d* are upright pieces extending from the lower side of the sliding portions 51*b* and 52*b*. The fixed supports 51*d* and 52*d* include surfaces 51*d*1 and 52*d*1 extending in the Z direction.

The movable plate 51 has a fixed contact 53 attached to the surface 51*d*1 of the fixed support 51*d*. The movable contact 55 is attached to the outer-surface of the sliding portion 51*b*. The movable plate 52 has a fixed contact 54 attached to the surface 52*d*1 of the fixed support 52*d*. The movable contact 56 is attached to the outer-surface of the sliding portion 52*b*.

As a result, a space, in which a component is disposed, can be secured in the middle of the lower case 60 without changing the external dimensions of the illuminated push-button switch 10A according to the embodiment.

In the illuminated push-button switch 10A according to the embodiment, the light source 40 including the LED 41 and the light guiding bar 42 is disposed in the space secured in the middle of the lower case 60. Thus, without changing the external dimensions, the illuminated push-button switch 10A including a uniformly illuminated button touch surface (the upper-surface of the key top 1) can be provided.

(Method for Assembling Illuminated Push-Button Switch)

An example method for assembling the illuminated push-button switch 10A configured as described above will now be described. The lower case 60 to which the contact mechanism 50 is assembled is attached to the base plate 7 embedded with the LED 41.

The light guiding bar 42 is inserted in the cylindrical insertion tube 61 of the lower case 60 to optically couple the LED 41 with the light guiding bar 42. The coil spring 30*b* is inserted in the insertion tube 62 of the lower case 60. By this insertion, the light guiding bar 42 is contained in the coil spring 30*b*.

From above the coil spring 30*b*, the plunger body 30*a* is attached to the lower case 60 with the four corners of the plunger body 30*a* each positioned on the inner side of each of the four corner projections 64. Consequently, the protrusion-and-recess surfaces 36*a* of the cams 36 make contact with the projecting tips 51*c*1 and 52*c*1 of the contact portions 51*c* and 52*c* of the movable plates 51 and 52 to urge the sliding portions 51*b* and 52*b* to deform outward. The movable contact 55 provided on the sliding portion 51*b* is therefore separated from the fixed contact 54 provided on the fixed support 52*d*. The movable contact 56 provided on the sliding portion 52*b* is also separated from the fixed contact 53 provided on the fixed support 51*d*.

The upper case 20 is then attached, and the key top 1 is attached by press-fitting the supporting fix members 2 of the key top 1 in the press-fit holes 34 and 34 and the press-fit holes 35 and 35 of the plunger 30. The assembly of the illuminated push-button switch 10A is thus completed.

(Method for Operating Illuminated Push-Button Switch)

Figure 8:
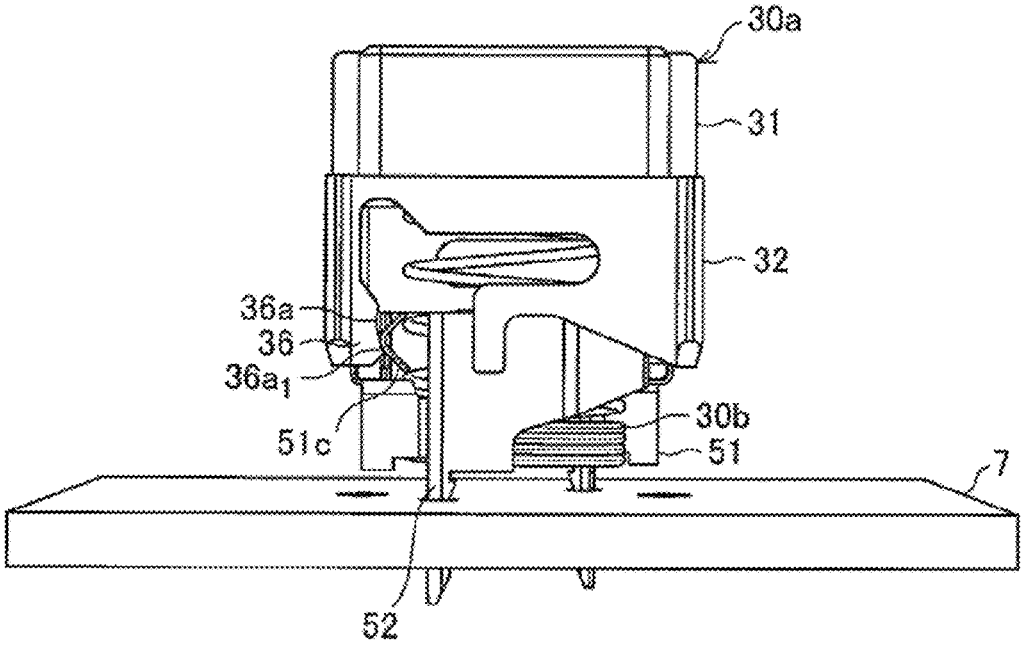
FIG. 8 is a side view illustrating the engagement between the plunger body and a movable plate in a state where the illuminated push-button switch is not yet pressed.
Figure 9:
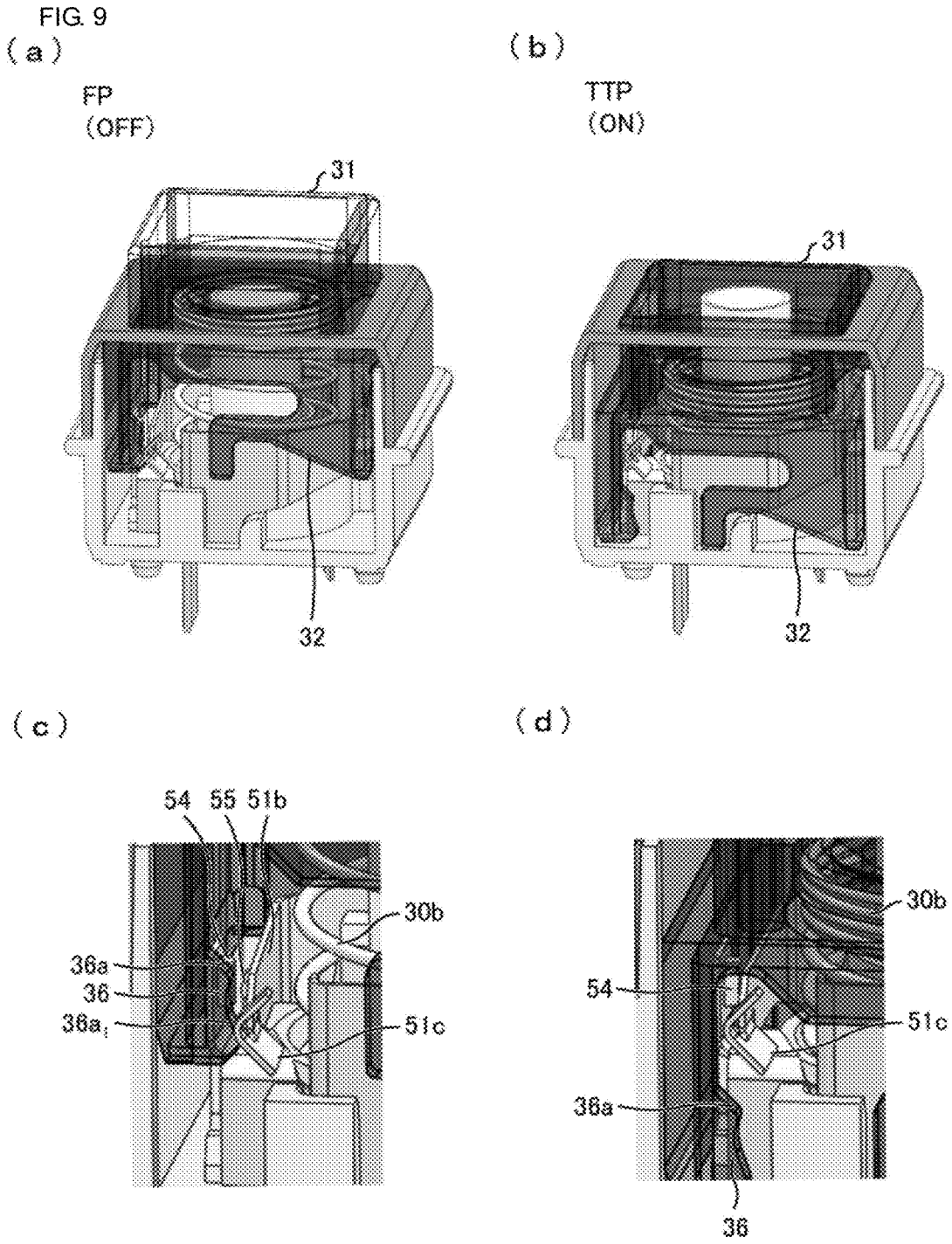
FIGS. 9(*a*) and 9(*b*) are sectional perspective views each illustrating a state in the operation of the illuminated push-button switch.

The method for operating the illuminated push-button switch 10A will now be described with reference to the FIGS. 8 and 9(*a*) to 9(*d*). FIG. 8 is a side view illustrating the engagement between the plunger body 30*a* and the movable plate 51 in a state where the illuminated push-button switch 10A is not yet operated. FIGS. 9(*a*) and 9(*b*) are sectional perspective views illustrating a state in the operation of the illuminated push-button switch 10A. FIGS. 9(*c*) and 9(*d*) are partially enlarged views each illustrating a motion of the contact portion 51*c* of the movable plate 51 and the cam 36 of the plunger body 30*a*. The opening and closing between the movable contact 55 and the fixed contact 54 made by pushing the illuminated push-button switch 10A will now be described below. Description on the opening and closing between the movable contact 56 and the fixed contact 53, which are similar to the opening and closing between the movable contact 55 and the fixed contact 54, is omitted.

As illustrated in FIGS. 8 and 9(*a*), before operating the illuminated push-button switch 10A, the coil spring 30*b* pushes upward by its spring force the plunger lower-wall 32 of the plunger body 30*a* to urge the plunger body 30*a* upward.

Before operating the illuminated push-button switch 10A, the contact portion 51*c* of the movable plate 51 is in contact with the protruding surface 36*a*1 of the protrusion-and-recess surface 36*a* of the cam 36 of the plunger body 30*a* via the projecting tip 51*c*1.

As illustrated in FIGS. 8 and 9(*c*), the sliding portion 51*b* of the movable plate 51 is elastically deformed in the direction perpendicular to the Z direction (hereinafter referred to as the transverse direction) to the inner side by the cam 36 via the contact with the contact portion 51*c*. Thus, before operating the illuminated push-button switch 10A, the elastic force of the sliding portion 51*b* applies a force that acts outward in the transverse direction to the contact portion 51*c* of the movable plate 51. The contact portion 51*c* is thus urged outward in the transverse direction. That is, the contact portion 51*c* pushes the cam 36 outward. The cam 36 of the plunger body 30*a* makes contact with the projecting tip 51*c*1 of the contact portion 51*c* of the movable plate 51 via the protrusion-and-recess surface 36*a* to catch the contact portion 51*c* urged outward in the transverse direction. In this state, the movable contact 55 provided on the sliding portion 51*b* is separated from the fixed contact 54 provided on the fixed support 52*d*.

As illustrated in FIGS. 8, 9(*b*), and 9(*d*), by pushing down the plunger upper-wall 31 of the plunger body 30*a*, the coil spring 30*b* flexes and the protrusion-and-recess surface 36*a* of the cam 36 slides while the projecting tip 51*c*1 of the contact portion 51*c* is urged outward in the transverse direction. When the contact portion 51*c* of the movable plate 51 is positioned above the cam 36 by pushing downward the plunger upper-wall 31 of the plunger body 30*a*, the cam 36 does not catch the contact portion 51*c* urged outward in the transverse direction any more. In this state, the movable contact 55 provided on the sliding portion 51*b* is in an electrical contact with the fixed contact 54 provided on the fixed support 52*d*.

When the plunger upper-wall 31 of the plunger body 30*a* is not pushed any more, the coil spring 30*b* pushes the plunger body 30*a* upward. Along with this upward motion, the contact portion 51*c* slides against the protrusion-and-recess surface 36*a* of the cam 36 of the plunger body 30*a*. The contact portion 51*c* engages with the protruding surface 36*a*1 of the protrusion-and-recess surface 36*a*. By this mechanism, the plunger body 30*a* and the movable plate 51 return to the positions where the plunger body 30*a* and the movable plate 51 have been before operating the illuminated push-button switch 10A.

Configuration for Securing Wide Illuminated Region of Touch Surface of Key Top

In the illuminated push-button switch 10A according to the embodiment as illustrated in FIG. 3, the key top 1 serving as a covering member covers at least the whole plunger upper-wall upper-surface 31*a*, which is the upper-surface of the push-button, of the plunger 30 serving as a push-button upper-surface. In most of the case for the illuminated push-button switch 10A that has the key top upper-surface 1*a*, serving as the covering member upper-surface, having an area larger than the inner area of the plunger upper-wall upper-surface 31*a*, a letter is displayed on the key top upper-surface 1*a*. Regarding illumination, it is thus preferable that the LED 41 serving as a light source illuminates the whole key top upper-surface 1*a*. The space occupied by the contact mechanism 50 serving as a contact unit however limits the cross sectional area of the LED 41 disposed in the middle of the plunger 30. For this reason, to irradiate the whole key top upper-surface 1*a* with light, the key top upper-surface 1*a* should be irradiated with the expanded light emitted from the LED 41, and objects that block the emitted light should be as minimal as possible.

Figure 10:
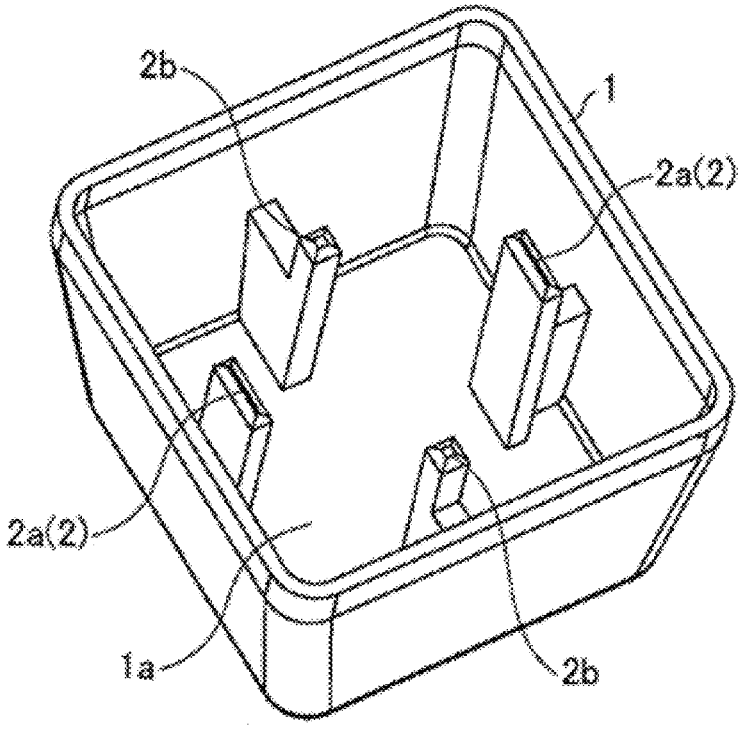
FIG. 10 is a perspective view illustrating a configuration of the inside of a key top of the illuminated push-button switch.
Figure 11:
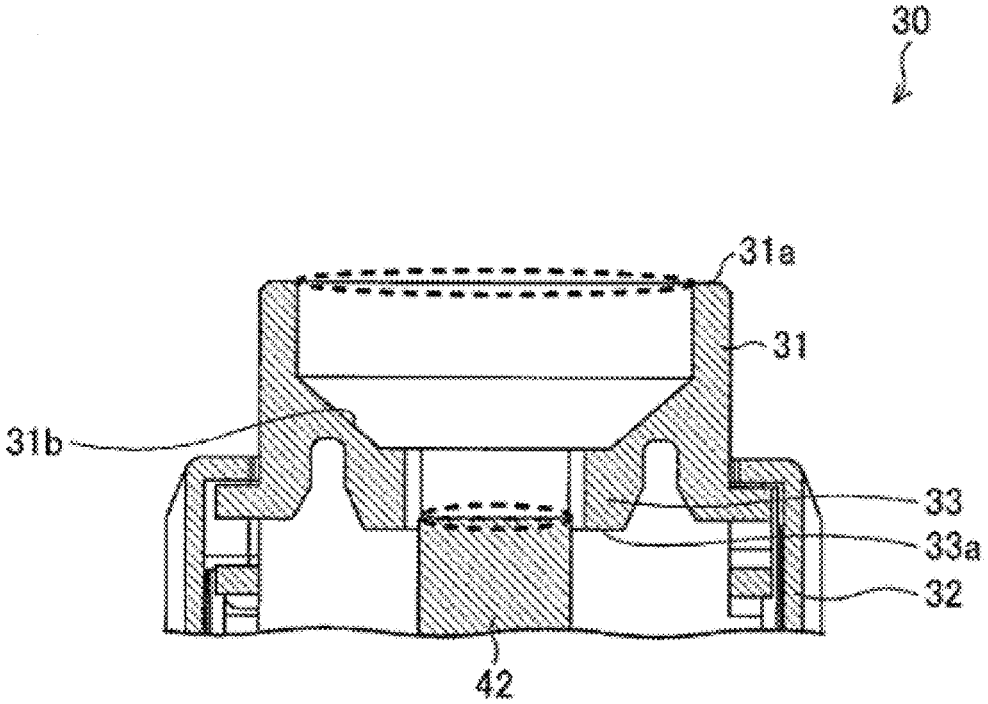
FIG. 11 is a sectional view illustrating the relationship between the plunger and a light guiding bar of the illuminated push-button switch.
Figure 12:
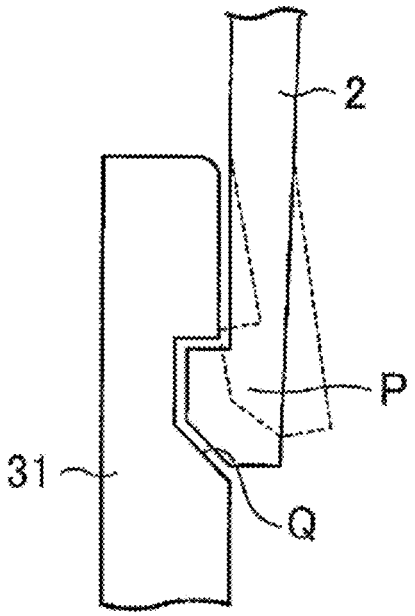
FIG. 12 is a side view illustrating a configuration of snap-fitting as an example of a supporting fix member of the illuminated push-button switch.
Figure 18:
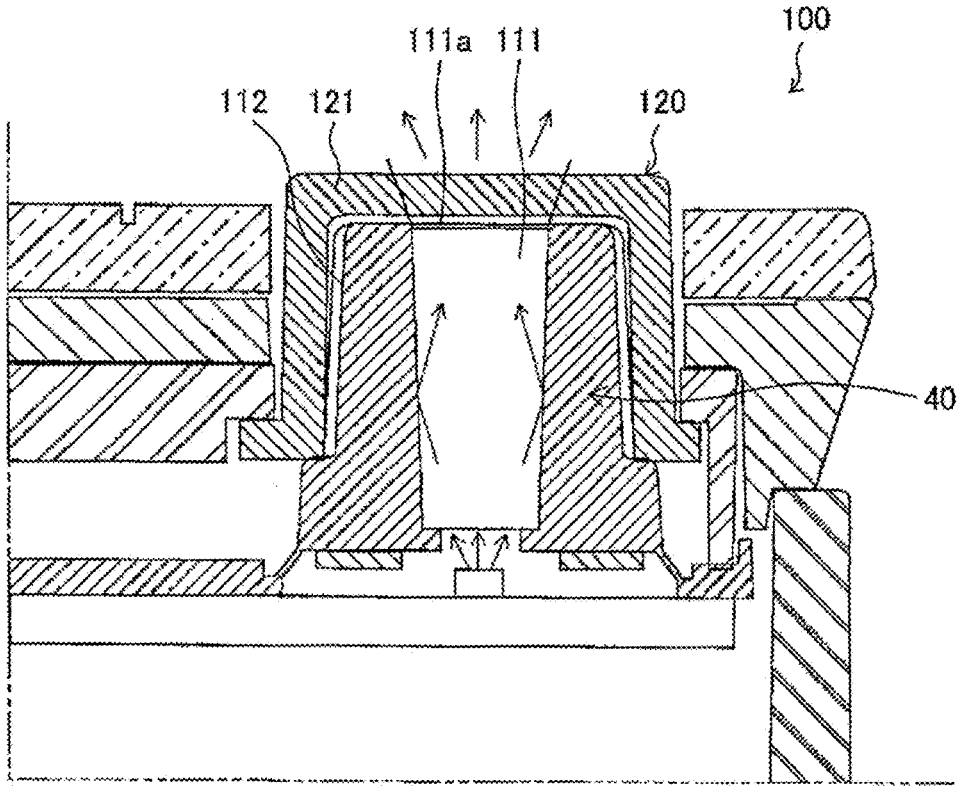
FIG. 18 is a sectional view illustrating a configuration of a conventional illuminated push-button switch.
Figure 19:
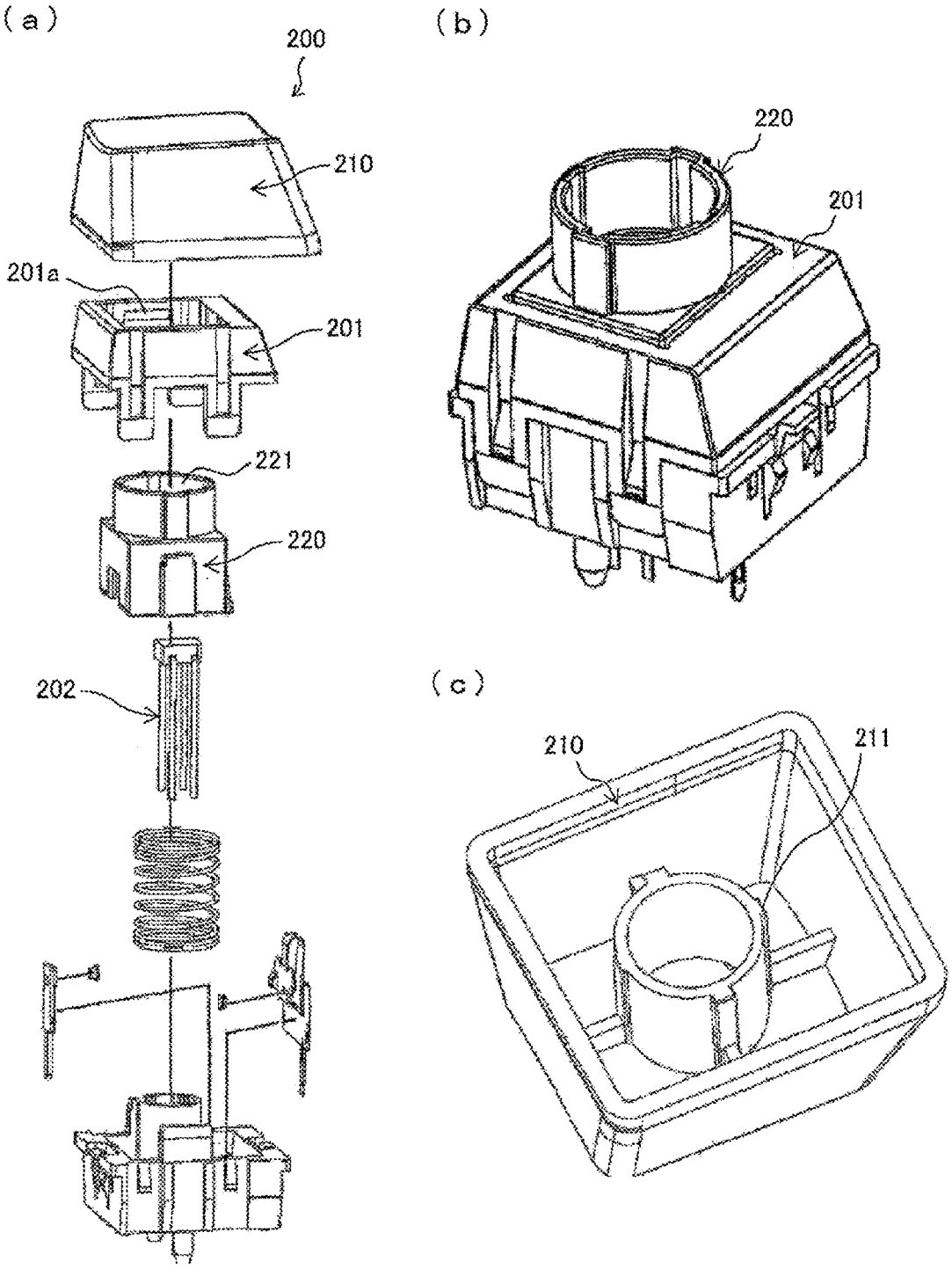
FIG. 19(*a*) is an exploded perspective view illustrating a configuration of another conventional illuminated push-button switch.

To solve the problems, the embodiment is configured as described below. A configuration for securing a wide illuminated region of the touch surface of the key top will now be described below with reference to FIGS. 1(*a*), 1(*b*) and 10 to 17(*b*). FIG. 1(*a*) is a longitudinal sectional view illustrating the configuration of the illuminated push-button switch 10A according to the embodiment. FIG. 1(*b*) is a transverse sectional view of the configuration of the illuminated push-button switch 10A. FIG. 10 is a perspective view illustrating the configuration of the inside of the key top 1 of the illuminated push-button switch 10A. FIG. 11 is a sectional view illustrating the relationship between the plunger 30 and the light guiding bar 42 of the illuminated push-button switch 10A. FIG. 12 is a side view illustrating a configuration of snap-fitting as an example of a supporting fix member 2 of the illuminated push-button switch 10A. FIG. 13(*a*) is a perspective view illustrating a configuration of an illuminated push-button switch 10B, which is an exemplary modification of the illuminated push-button switch 10A according to the embodiment. FIG. 13(*b*) is a transverse sectional view of the configuration of the exemplary modification of the illuminated push-button switch 10B. FIG. 14(*a*) is a perspective view illustrating a configuration of an illuminated push-button switch 10C, which is another exemplary modification of the illuminated push-button switch 10A according to the embodiment. FIG. 14(*b*) is a transverse sectional view illustrating the configuration of the illuminated push-button switch 10C, which is the exemplary modification of the illuminated push-button switch 10A according to the embodiment. FIG. 15(*a*) is a perspective view illustrating a configuration of an illuminated push-button switch 10D, which is still another exemplary modification of the illuminated push-button switch 10A according to the embodiment. FIG. 15(*b*) is a transverse sectional view illustrating the configuration of the illuminated push-button switch 10D, which is the exemplary modification of the illuminated push-button switch 10A according to the embodiment. FIG. 16(*a*) is a longitudinal sectional view illustrating a configuration of an illuminated push-button switch 90A, which is a comparative example of the illuminated push-button switch 10A according to the embodiment. FIG. 16(*b*) is a transverse sectional view illustrating the configuration of the illuminated push-button switch 90A, which is the comparative example of the illuminated push-button switch 10A according to the embodiment. FIG. 17(*a*) is a longitudinal sectional view illustrating a configuration of an illuminated push-button switch 90B, which is another comparative example of the illuminated push-button switch 10A according to the embodiment. FIG. 17(*b*) is a transverse sectional view illustrating the configuration of the illuminated push-button switch 90B, which is the comparative example of the illuminated push-button switch 10A according to the embodiment.

To solve the aforementioned problems, as illustrated in FIGS. 1(*a*) and 1(*b*), in the illuminated push-button switch 10A according to the embodiment, supporting fix members 2 that form a space between the key top 1 and the plunger upper-wall 31 of the plunger 30, and support and fix together the key top 1 and the plunger upper-wall 31 are provided on the inner side of the key top 1. In the embodiment, a plurality of supporting fix members 2 are provided, separated from each other, in a plane perpendicular to the optical axis of the LED 41.

Specifically, as illustrated in FIG. 10, insertion tabs 2*a* and 2*a* serving as the supporting fix members 2 are provided on one of pairs of opposing sides on the inner side of the square-box-shaped key top 1. The insertion tabs 2*a* and 2*a* are separately provided in the middle of each side. The locations of the insertion tabs 2*a* and 2*a* are point-symmetric in a plane perpendicular to the optical axis of the LED 41. In the embodiment, insertion pins 2*b* and 2*b* serving as the supporting fix members 2 are provided on the other pair of opposing sides on the inner side of the square-box-shaped key top 1. The insertion pins 2*b* and 2*b* are separately provided in the middle of each side. The locations of the insertion pins 2*b* and 2*b* are point-symmetric in a plane perpendicular to the optical axis of the LED 41. As illustrated in FIG. 1(*b*), the insertion tabs 2*a* and 2*a* and the insertion pins 2*b* and 2*b* are to be inserted in the press-fit holes 34 and 34 and the press-fit holes 35 and 35 provided on the circumference of the plunger upper-wall upper-surface 31*a* of the plunger 30.

In the embodiment, the insertion pins 2*b* and 2*b* serving as the supporting fix members 2 are provided on the other pair of opposing sides on the inner side of the square-box-shaped key top 1. The insertion pins 2*b* and 2*b* are separately provided, at point-symmetric locations, in the middle of each side. The present invention however is not necessarily required to have such a configuration. The other pair of insertion pins 2*b* and 2*b* may not exist. That is, in the present invention, the insertion tabs 2*a* and 2*a*, for example, serving as supporting fix members 2 may be provided at least on one of pairs of opposing sides in the inner side of the square-box-shaped key top 1, where the insertion tabs 2*a* and 2*a* are separately provided in the middle of each side, and the locations of the insertion tabs 2*a* and 2*a* are point-symmetric in a plane perpendicular to the optical axis of the LED 41.

That is, the insertion tabs 2*a* and 2*a* each have a linear side along the circumference of the plunger upper-wall upper-surface 31*a*. The insertion pins 2*b* and 2*b* each have a pin-shaped distal end.

With such a configuration, the insertion tabs 2*a* and 2*a* and the insertion pins 2*b* and 2*b*, serving as the supporting fix members 2, forming a space between the key top 1 and the plunger 30 are capable of supporting, for example, two points which are point-symmetric approximately about the gravity center of the key top 1. For example, if the key top 1 is a cantilever, that is, supported only by a single point, the supporting fix member 2 needs to have a sufficient strength to prevent breakage. By providing support by at least two points, an axial load is evenly distributed on the supporting fix members 2 and 2. Accordingly, the supporting fix members 2 and 2 need not have such a high strength.

As a result, the supporting fix members 2 can be made thin, which widens the gap between the two supporting fix members 2 and 2. Therefore, the blocking of the emitted light from the plunger upper-wall upper-surface 31*a* by the supporting fix members 2 can be avoided as much as possible. Consequently, as illustrated in FIG. 1(*a*), an irradiated area S2, which is an illuminated region wider than a push-button light exit region S1 of the plunger upper-wall upper-surface 31*a* can be secured on the key top upper-surface 1*a*.

The insertion tabs 2*a* and 2*a* and the insertion pins 2*b* and 2*b* each has a plate-like or a pin-like cross section. The cross section is not limited to such a shape but may be, for example, a circle, an ellipse, an elongate circle, or a polygon.

In the illuminated push-button switch 10A according to the embodiment, the circumferential length of the insertion tabs 2*a* and 2*a* serving as the supporting fix members 2 is half the outer dimension of the plunger upper-wall upper-surface 31*a* or smaller.

Thus, the insertion tabs 2*a* and 2*a* serving as the supporting fix members 2 are provided with a sufficient strength and blocking of the emitted light from the plunger upper-wall upper-surface 31*a* by the insertion tabs 2*a* and 2*a* serving as the supporting fix members 2 can be avoided as much as possible. Consequently, the irradiated area S2 wider than the push-button light exit region S1 of the plunger upper-wall upper-surface 31*a* can be secured on the key top upper-surface 1*a*.

Consequently, the illuminated push-button switch 10A having a wide illuminated region secured on the touch surface can be provided.

Regarding the case, as a comparative example of the embodiment, where the plunger upper-wall upper-surface 31*a* is in close contact with the key top 1 as disclosed in Patent Document 1, an illuminated push-button switch 90A illustrated in FIGS. 16(*a*) and 16(*b*), which is the comparative example, has an irradiated area S3 on the key top upper-surface 1*a* approximately identical to the push-button light exit region S1 of the plunger upper-wall upper-surface 31*a*.

Regarding the case, as another comparative example of the embodiment, where a cylindrical part is provided in the inside of the key top 1 to make close contact with the plunger upper-wall upper-surface 31*a* as disclosed in Patent Document 2, the illuminated push-button switch 90B illustrated in FIG. 17, which is the comparative example, has an irradiated area S4 on the key top upper-surface 1*a* approximately identical to the push-button light exit region S1 of the plunger upper-wall upper-surface 31*a*.

As a result, the wider irradiated area S2 is provided on the key top upper-surface 1*a* by employing the configuration of the illuminated push-button switch 10A according to the embodiment.

In the illuminated push-button switch 10A according to the embodiment, the supporting fix members 2 provided as projections formed on the inner side of the key top 1, serving as the insertion tabs 2*a* and 2*a* and the insertion pins 2*b* and 2*b*, are press-fit in the press-fit holes 34 and 34 and the press-fit holes 35 and 35 provided in the other plunger upper-wall 31 as insertion holes.

The strength to fix together the plunger upper-wall 31 of the plunger 30 and the key top 1 is thereby secured. Specifically, in the method of press-fitting the insertion pins 2*b* and 2*b* provided on the key top 1 in press-fit holes 31*c* and 31*c* provided in the other one, that is, the plunger upper-wall 31, the insertion pins 2*b* and 2*b* can be provided as thin pins to simplify the configuration. Accordingly, blocking of light by the insertion pins 2*b* and 2*b* can be avoided as much as possible.

In the illuminated push-button switch 10A according to the embodiment, the insertion tabs 2*a* and 2*a* and the insertion pins 2*b* and 2*b* serving as the supporting fix members 2 are provided in the outer side of the push-button light exit region 51 of the plunger upper-wall upper-surface 31*a*.

Thus, the insertion tabs 2*a* and 2*a* and the insertion pins 2*b* and 2*b* serving as the supporting fix members 2 do not exist directly above the push-button light exit region 51 of the plunger upper-wall upper-surface 31*a*. Therefore, in the key top 1, the space directly above the insertion tabs 2*a* and 2*a* and the insertion pins 2*b* and 2*b* serving as the supporting fix members 2 does not get dark by the supporting fix members 2 blocking the light.

As illustrated in FIG. 1(*a*), in the illuminated push-button switch 10A according to the embodiment, the plunger upper-wall 31 of the plunger 30 serving as the push-button is provided with a plunger through hole 31*b* serving as a push-button hole that extends from a plunger floor bottom-surface 33*a*, which is the push-button bottom-surface, to the plunger upper-wall upper-surface 31*a*. The plunger through hole 31*b* has a wider opening area on the plunger upper-wall upper-surface 31*a* than the opening area on the plunger floor 33.

With the opening area on the plunger upper-wall upper-surface 31*a* being larger than the opening area on the plunger floor 33, the plunger through hole 31*b* allows the light-illuminated-area by the LED 41 to enlarge also inside the plunger 30.

As a result, the illuminated area on the plunger upper-wall upper-surface 31*a* can be enlarged, and the irradiated area S2 on the key top upper-surface 1*a* is inevitably enlarged.

Consequently, the illuminated push-button switch 10A having the wide irradiated area S2 secured on the touch surface can be provided.

Furthermore, in the illuminated push-button switch 10A according to the embodiment, the LED 41 serving as a light source that emits light is provided in a transverse cross section, in the lower side, of the plunger 30.

With the LED 41 provided in the transverse cross section of the plunger 30, the illuminated push-button switch 10A that has a wide irradiated area S2 secured on the touch surface, which is the key top upper-surface 1*a*, can be provided.

As illustrated in FIG. 11, the illuminated push-button switch 10A according to the embodiment is provided with the light guiding bar 42 serving as a light guiding member which the light enters from below the plunger 30. The light entering from below the plunger 30 is guided by the light guiding bar 42 to be emitted through the plunger 30 onto the key top upper-surface 1*a*.

Since the light guiding bar 42 has a high optical transmittance, the light emitted from the LED 41 does not attenuate so much. Therefore, the key top upper-surface 1*a* can be irradiated efficiently with the light emitted from LED 41.

This increases the luminance of the key top upper-surface 1*a* serving as a touch surface.

A keyboard according to the embodiment includes the illuminated push-button switch 10A according to the embodiment.

Thus, the keyboard including the illuminated push-button switch 10A having a wide irradiated area S2 secured on the key top upper-surface 1*a* can be provided.

The present invention is not limited to the embodiments described above. Various modifications can be made within the scope of the present invention. In the above description, for example, the supporting fix members 2 of the embodiment provided as the insertion tabs 2*a* and 2*a* and the insertion pins 2*b* and 2*b* serving as projections, which are formed in the back side of the key top 1 provided as a covering member, are press-fit in the press-fit holes 34 and 34 and the press-fit holes 35 and 35 provided in the other one, that is, the plunger 30. The method of fixing the supporting fix members 2 however is not limited to such a configuration. Snap-fitting can also be used.

As illustrated in FIG. 12, the snap-fitting is a mechanical assembly method in which a projecting portion P provided on the supporting fix member 2 is fitted and held in a recessed portion Q of the plunger upper-wall 31, which serves as a receiver, using the elasticity of the material of the supporting fix member 2.

By using the snap-fitting, a sufficient strength to fix together the plunger 30 and the key top 1 can easily be secured.

As illustrated in FIGS. 1(*a*) and 1(*b*), the illuminated push-button switch 10A according to the embodiment is provided with the insertion tabs 2*a* and 2*a* separately provided on one of pairs of opposing sides in the inner side of the square-box-shaped key top 1, where the insertion tabs 2*a* and 2*a* are provided in the middle of each side so as to be located in a point-symmetric manner. The arrangement of the insertion tabs 2*a* and 2*a* is not limited to such a configuration. As illustrated in FIGS. 13(*a*) and 13(*b*), the configuration may be of an illuminated push-button switch 10B that includes insertion tabs 2*c* and 2*c* separately provided on one of pairs of opposing sides in the inner side of a square-box-shaped key top 1, where the insertion tabs 2*a* and 2*a* are each provided at an end of the side so as to be located in a point-symmetric manner.

Regarding a pair of point-symmetric locations, the supporting fix members 2 and 2 are not necessarily located in the middle of each side.

In the illuminated push-button switch 10A according to the embodiment as illustrated in FIGS. 1(*a*) and 1(*b*), the insertion tabs 2*a* and 2*a* and the insertion pins 2*b* and 2*b* are provided as the supporting fix members 2 in the inner side of the key top 1, and the press-fit holes 34 and 34 and the press-fit holes 35 and 35 are provided in the plunger upper-wall 31 of the plunger 30.

The embodiment is however not limited to this configuration. As illustrated in FIGS. 14(*a*) and 14(*b*), for example, the configuration may be of an illuminated push-button switch 10C that includes insertion tabs 2*a* and 2*a* and insertion pins 2*b* and 2*b* provided as supporting fix members 2 on a plunger upper-wall 31 of a plunger 30 and press-fit holes 1*b* and 1*b* and press-fit holes 1*c* and 1*c* provided in the inner side of a key top 1.

In the illuminated push-button switch 10A according to the embodiment, the insertion pins 2*b* and 2*b* are provided in the inner side of a push-button light exit region S1 of a plunger upper-wall upper-surface 31*a*. The embodiment is however not limited to this configuration. As illustrated in FIGS. 15(*a*) and 15(*b*), for example, the configuration may be of an illuminated push-button switch 10D that includes insertion pins 2*b* and 2*b* provided in the outer side of a push-button light exit region S1 of a plunger upper-wall upper-surface 31*a* like insertion tabs 2*a* and 2*a*.

With such a configuration, the insertion tabs 2*a* and 2*a* and the insertion pins 2*b* and 2*b* serving as the supporting fix members 2 do not exist directly above the push-button light exit region S1 of the plunger upper-wall upper-surface 31*a*. Therefore, in the key top 1, the space directly above the insertion tabs 2*a* and 2*a* and the insertion pins 2*b* and 2*b* serving as the supporting fix members 2 does not get dark by the supporting fix members 2 blocking the light.

As described above, the illuminated push-button switch 10A according to the embodiment includes the plunger 30 as a push-button and a key top 1 as a covering member that covers at least the plunger upper-wall upper-surface 31*a*, serving as a push-button upper-surface, of the plunger 30. The key top upper-surface 1*a* serving as a covering member upper-surface is irradiated with the light that has entered the plunger 30 from below and passed through the plunger 30. The key top upper-surface 1*a* serving as a touch surface, is pushed or released to set on or off the contact mechanism 50 serving as a contact unit via the plunger 30.

The supporting fix members 2 that form a space between the key top 1 and the plunger 30, and support and fix together the key top 1 and the plunger 30 are provided. A plurality of supporting fix members 2 and 2 are provided, separated from each other, in a plane perpendicular to the optical axis.

In this configuration, the space provided between the key top 1 and the plunger 30 allows the light that exits from the plunger 30 to expand before reaching the key top upper-surface 1*a*. A plurality of supporting fix members 2 that form a space between the key top 1 and the plunger 30, and support and fix together the key top 1 and the plunger 30 are provided, separated from each other, in a plane perpendicular to the optical axis. Accordingly, the light passes through the gap between the supporting fix members 2 and 2.

The light emitted from the plunger upper-wall upper-surface 31*a* can therefore reach the key top upper-surface 1*a* by passing the gap between the supporting fix members 2 and 2.

As a result, the blocking of the emitted light from the plunger upper-wall upper-surface 31*a* by the supporting fix members 2 can be avoided as much as possible, and the irradiated area S2 wider than the push-button light exit region S1 of the plunger upper-wall upper-surface 31*a* can be secured on the key top upper-surface 1*a*.

Consequently, the illuminated push-button switch 10A having the wide irradiated area S2 secured as an illuminated region of the touch surface can be provided.

In the illuminated push-button switch 10A according to the embodiment, the supporting fix members 2 are separately provided at least at a pair of point-symmetric locations in a plane perpendicular to the optical axis.

As a result, the supporting fix members 2 can be made thin, which widens the gap between two supporting fix members 2 and 2. Thus, the blocking of the emitted light from the plunger upper-wall upper-surface 31*a* by the supporting fix members 2 can be avoided as much as possible, and the irradiated area S2 wider than the push-button light exit region S1 of the plunger upper-wall upper-surface 31*a* can be secured on the key top upper-surface 1*a*.

In the illuminated push-button switch 10A according to the embodiment, the supporting fix members 2 are provided in the outer side of the push-button light exit region S1 of the plunger upper-wall upper-surface 31*a*.

Thus, the supporting fix members 2 do not exist directly above the push-button light exit region S1 of the plunger upper-wall upper-surface 31*a*. Therefore, the region of the key top upper-surface 1*a* directly above the supporting fix member 2 does not get dark by the supporting fix member 2 blocking the light.

In the illuminated push-button switch 10A according to the embodiment, the circumferential length of each of the supporting fix members 2 is half the outer dimension of the key top upper-surface 1*a* or smaller.

Consequently, the illuminated push-button switch 10A having the wide irradiated area S2 secured on the touch surface can be provided.

In the illuminated push-button switches 10A to 10D according to the embodiments, the supporting fix members 2 are provided to support and fix together the plunger 30 and the key top 1 by press-fitting the insertion tabs 2*a* and 2*a* or the insertion pins 2*b* and 2*b*, which are the projections provided on either of the plunger 30 and the key top 1, in the press-fit holes 34 and 34 and the press-fit holes 35 and 35 or the press-fit holes 1*b* and 1*b* and the press-fit holes 1*c* and 1*c*, which are insertion holes provided in the other one, that is, the plunger 30, or by snap-fitting.

In this manner, the supporting fix members 2 can be provided, for example, as thin pins to simplify the configuration. Accordingly, blocking of light by the supporting fix members 2 can be avoided as much as possible.

Furthermore, a sufficient strength to fix together the plunger 30 and the key top 1 can be secured easily by using snap-fitting.

In the illuminated push-button switch 10A according to the embodiment, the plunger through hole 31*b* is provided in the plunger 30 to extend from the plunger floor bottom-surface 33*a* to the plunger upper-wall upper-surface 31*a*, and the plunger through hole 31*b* has the wider opening area on the plunger upper-wall upper-surface 31*a* than the opening area on the plunger floor bottom-surface 33*a*.

As a result, the push-button light exit region S1 of the plunger upper-wall upper-surface 31*a* can be enlarged, and the irradiated area S2 on the key top upper-surface 1*a* is inevitably enlarged. Consequently, the illuminated push-button switch 10A having the wide irradiated area S2 secured on the touch surface can be provided.

In the illuminated push-button switch 10A according to the embodiment, the light guiding bar 42 which the light enters from below the plunger 30 is provided, and the light entering from below the plunger 30 is guided by the light guiding bar 42 to be emitted through the plunger 30 onto the key top upper-surface 1*a*.

Since the light guiding bar 42 has a high optical transmittance, the light emitted from the LED 41 does not attenuate so much. Therefore, the key top upper-surface 1*a* can be irradiated efficiently with the light emitted from LED 41. This increases the luminance of the touch surface.

In the illuminated push-button switch 10A according to the embodiment, the LED 41 that emits light is provided in a transverse cross section, in the lower side, of the plunger 30. With the LED 41 provided in the transverse cross section of the plunger 30, the illuminated push-button switch 10A that has a wide irradiated area S2 secured on the touch surface can be provided.

The keyboard according to the embodiment includes any one of the illuminated push-button switches 10A to 10D. Thus, the keyboard including any one of the illuminated push-button switches 10A to 10D having a wide irradiated area S2 secured on the touch surface can be provided.

The present invention is not limited to the embodiments described above. Various modifications can be made within the scope of the claims. The technical means disclosed in the embodiments may be combined as required to constitute an embodiment which also falls within the technical scope of the present invention.

As described above, to solve the aforementioned problems, an illuminated push-button switch according to one embodiment of the present invention includes a push-button and a covering member that covers at least a push-button upper-surface of the push-button. The light entering from below the push-button is emitted through the push-button onto a covering member upper-surface. The illuminated push-button switch includes a contact unit that is set on or off via the push-button by pushing the covering member upper-surface serving as a touch surface. A supporting fix member forms space between the covering member and the push-button, and supports and fixes together the covering member and the push-button. A plurality of the supporting fix members are provided, separated from each other, in a plane perpendicular to an optical axis.

According to the present invention, the space provided between the covering member and the push-button allows the light emitted from the push-button to enlarge before reaching the covering member upper-surface. A plurality of supporting fix members that form a space between the covering member and the push-button, and support and fix together the covering member and the push-button are provided, separated from each other, in a plane perpendicular to the optical axis. Accordingly, the light passes the gap between the supporting fix members.

The light emitted from the push-button upper-surface can therefore reach the covering member upper-surface by passing the gap between the supporting fix members.

As a result, the blocking of the emitted light from the push-button upper-surface by the supporting fix members can be avoided as much as possible, and the irradiated area wider than the push-button light exit region of the push-button upper-surface can be secured on the covering member upper-surface.

Consequently, the illuminated push-button switch having a wide illuminated region secured on the touch surface can be provided.

In the illuminated push-button switch according to one embodiment of the present invention, the supporting fix members are separately provided at least at a pair of point-symmetric locations in a plane perpendicular to the optical axis.

By supporting by at least two points, an axial load is evenly distributed on the supporting fix members, and thus the supporting fix members need not have such a high strength.

As a result, the supporting fix members can be made thin, which widens the gap between the two supporting fix members. Therefore, the blocking of the emitted light from the push-button upper-surface by the supporting fix members can be avoided as much as possible, and the irradiated area wider than the push-button light exit region of the push-button upper-surface can be secured on the covering member upper-surface.

In the illuminated push-button switch according to one embodiment of the present invention, the supporting fix members are preferably provided in the outer side of the push-button light exit region of the push-button upper-surface.

In this configuration, the supporting fix members do not exist directly above the push-button light exit region of the push-button upper-surface. Therefore, the region of the covering member upper-surface directly above the supporting fix members does not get dark by the supporting fix members blocking the light.

In the illuminated push-button switch according to one embodiment of the present invention, the circumferential length of each of the supporting fix members is half the outer dimension of the push-button upper-surface or smaller.

Consequently, the illuminated push-button switch having a wide illuminated region secured on the touch surface can further surely be provided.

In the illuminated push-button switch according to one embodiment of the present invention, the supporting fix members are preferably provided to support and fix together the push-button and the covering member by press-fitting the projections provided on either of the push-button and the covering member in the insertion holes provided in the other one, or by snap-fitting.

In this manner, the strength to fix together the push-button and the covering member can be secured. Specifically, in the method of press-fitting the projections provided on one of the push-button and the covering member in the holes provided in the other one, the supporting fix members can be provided as, for example, thin pins to simplify the configuration. Accordingly, blocking of light by the supporting fix members can be avoided as much as possible.

Furthermore, a sufficient strength to fix together the push-button and the covering member can be secured easily by using snap-fitting.

In the illuminated push-button switch according to one embodiment of the present invention, the push-button hole is preferably provided in the push-button to extend from the push-button bottom-surface to the push-button upper-surface, and the push-button hole preferably has the larger opening area on the push-button upper-surface than the opening area on the push-button bottom-surface.

This enlarges, also inside the push-button, the area illuminated with the light from the light source. As a result, the illuminated area on the push-button upper-surface can be enlarged, and the irradiated area on the covering member upper-surface is inevitably enlarged.

Consequently, the illuminated push-button switch having a wide illuminated region secured on the touch surface can be provided.

In the illuminated push-button switch according to one embodiment of the present invention, the light guiding member which the light enters from below the push-button is preferably provided, and the light entering from below the push-button is preferably guided by the light guiding member to be emitted through the push-button onto the covering member upper-surface.

Since the light guiding member has a high optical transmittance, the light emitted from the light source does not attenuate so much. The covering member upper-surface can therefore be irradiated efficiently with the light emitted from the light source. This increases the luminance of the touch surface.

In the illuminated push-button switch according to one embodiment of the present invention, the light source that emits light can be provided in a transverse cross section, in the lower side, of the push-button.

With the light source provided in the transverse cross section of the push-button, the illuminated push-button switch that has a wide illuminated region secured on the touch surface can be provided.

To solve the aforementioned problems, the keyboard according to one embodiment of the present invention includes the illuminated push-button switch.

According to the present invention, the keyboard including the illuminated push-button switch that has a wide illuminated region secured on the touch surface can be provided.

INDUSTRIAL APPLICABILITY

The present invention relates to a switch including a contact, more particularly, to an illuminated push-button switch assembled in, for example, a keyboard, a game machine, an industrial operation panel, an imaging device control panel for professional use, or a commercial device.

DESCRIPTION OF SYMBOLS

1 key top (covering member)
1*a* key top upper-surface (covering member upper-surface)
1*b*, 1*c* press-fit hole (insertion hole)
2 supporting fix member
2*a* insertion tab (supporting fix member)
2*b* insertion pin (supporting fix member)
7 base plate
10A to 10D illuminated push-button switch
20 upper case
21 inner space
30 plunger (push-button)
30*a* plunger body
30*b* coil spring
31 plunger upper-wall
31*a* plunger upper-wall upper-surface (push-button upper-surface)
31*b* plunger through hole (push-button hole)
32 plunger lower-wall
33 plunger floor
33*a* plunger floor bottom-surface (push-button bottom-surface)
34 press-fit hole (insertion hole)
35 press-fit hole (insertion hole)
36 cam
40 light source
41 LED
42 light guiding bar (light guiding member)
50 contact mechanism (contact unit)
51, 52 movable plate
53, 54 fixed contact
55, 56 movable contact
60 lower case
61 cylindrical insertion tube
62 insertion tube
S1 button light exit region
S2 irradiated area (illuminated region)

The invention claimed is:

1. An illuminated push-button switch comprising:

a push-button including a plunger body having a plunger through hole, wherein the plunger body comprises a push-button upper-surface of the push-button at an upper end of the plunger through hole;

a covering member configured to cover at least the push-button upper-surface of the push-button and having a covering member upper-surface wall receiving light from below the push-button through the plunger through hole of the push-button, wherein the plunger through hole extends from a push-button bottom-surface to the push-button upper-surface, and the plunger through hole has a larger opening area on the push-button upper-surface than an opening area on the push-button bottom-surface;

a contact unit configured to be set on or off via the push-button by pushing the covering member upper-surface wall; and a plurality of supporting fix members fixing the covering member to the plunger body of the push-button and forming an unoccupied space between the covering member upper-surface wall of the covering, member and the push-button upper-surface of the plunger body, wherein the plurality of supporting fix members are provided, separated from each other, in a plane perpendicular to an optical axis.

2. The illuminated push-button switch according to claim 1, wherein the supporting fix members are separately provided at least at a pair of point-symmetric locations in the plane perpendicular to the optical axis.

3. The illuminated push-button switch according to claim 1, wherein the supporting fix members are provided outside of a push-button light exit region of the push-button upper-surface.

4. The illuminated push-button switch according to claim 1, wherein a circumferential length of each of the supporting fix members is half an outer dimension of the push-button upper-surface or smaller.

5. The illuminated push-button switch according to claim 1, wherein each of the supporting fix members is provided to fix together the plunger body of the push-button and the covering member by press-fitting a projection provided on either of the plunger body of the push-button and the covering member in an insertion hole provided in an other one of the plunger body of the push-button and the covering member, or by snap-fitting.

6. The illuminated push-button switch according to claim 1, further comprising a light guiding member configured to receive the light from below the push-button, and to guide the light onto the covering member upper-surface wall through the plunger through hole.

7. The illuminated push-button switch according to claim 1, further comprising a light source configured to emit light and provided in an lower end of the plunger through hole as seen in the optical axis.

8. A keyboard comprising the illuminated push-button switch according to claim 1.

9. The illuminated push-button switch according to claim 1, wherein the covering member comprises: the covering member upper-surface wall; and a covering member side wall extending downwardly from the covering member upper-surface wall and surrounding the plunger body, and each of the supporting fix members includes a projection extending downwardly from the covering member upper-surface wall along the optical axis direction and extending inwardly from the covering member side wall in a radial direction with respect to the optical axis.

* * * * *